US010000987B2

(12) United States Patent
Springett et al.

(10) Patent No.: US 10,000,987 B2
(45) Date of Patent: Jun. 19, 2018

(54) BLOWOUT PREVENTER MONITORING SYSTEM AND METHOD OF USING SAME

(71) Applicant: National Oilwell Varco, L.P., Houston, TX (US)

(72) Inventors: Frank B. Springett, Spring, TX (US); Clayton J. Simmons, Houston, TX (US); James D. Brugman, Spring, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 456 days.

(21) Appl. No.: 14/185,552

(22) Filed: Feb. 20, 2014

(65) Prior Publication Data

US 2014/0231075 A1 Aug. 21, 2014

Related U.S. Application Data

(60) Provisional application No. 61/767,685, filed on Feb. 21, 2013.

(51) Int. Cl.

| | |
|---|---|
| ***E21B 33/064*** | (2006.01) |
| ***E21B 33/06*** | (2006.01) |
| ***E21B 34/16*** | (2006.01) |

(52) U.S. Cl.

CPC ..... *E21B 33/064* (2013.01); *E21B 33/06* (2013.01); *E21B 34/16* (2013.01)

(58) Field of Classification Search

CPC ..... E21B 33/062; E21B 34/16; E21B 33/064

See application file for complete search history.

(56) References Cited

U.S. PATENT DOCUMENTS

| | | | |
|---|---|---|---|
| 1,161,705 | A | 11/1915 | Lloyd et al. |
| 2,178,698 | A | 11/1939 | Penick et al. |
| 2,231,613 | A | 2/1941 | Burke |
| 2,304,793 | A | 12/1942 | Bodine, Jr. |

(Continued)

OTHER PUBLICATIONS

"eHawk Remote BOP Monitor", National Oilwell Varco, 2012, 1 page.

(Continued)

*Primary Examiner* — D. Andrews
(74) *Attorney, Agent, or Firm* — Conley Rose, P.C.

(57) ABSTRACT

A blowout prevent unit and methods for monitoring a blowout preventer at a wellsite are provided. The blowout preventer is activatable to form a seal to prevent leakage of the fluid produced from subsurface formations. The blowout preventer unit includes wellsite databases, at least one control unit, and blowout preventer outputs. The wellsite databases are operatively connectable to the wellsite to receive wellsite data therefrom and have communication links therebetween. The control unit is operatively connectable to the wellsite databases to selectively divert the wellsite data therebetween via the communication links. The at least one control unit includes a processor to determine blowout preventer parameters from the diverted wellsite data. The blowout preventer outputs are operatively coupled to the wellsite databases, and are accessible by users. The blowout preventer outputs include blowout preventer dashboards to selectively display the blowout preventer parameters whereby blowout preventer conditions are viewable by the users.

34 Claims, 26 Drawing Sheets

(56) References Cited

U.S. PATENT DOCUMENTS 2,555,069 A 5/1951 Verney
2,592,197 A 4/1952 Schweitzer
2,596,851 A 5/1952 Hansen
2,752,119 A 6/1956 Allen et al.
3,040,611 A 6/1956 Tournaire
2,919,111 A 12/1959 Nicolson
3,145,462 A 8/1964 Bogner
3,272,222 A 9/1966 Allen et al.
3,399,728 A 9/1968 Taylor
3,427,554 A * 2/1969 Lagoe ..... E21B 33/0355 367/113
3,554,278 A 1/1971 Reistle, III et al.
3,554,480 A 1/1971 Rowe
3,561,526 A 9/1971 Williams et al.
3,647,174 A 3/1972 LeRouax
3,670,761 A 6/1972 LeRouax
3,716,068 A 2/1973 Addison
3,741,296 A 6/1973 Murman et al.
3,744,749 A 7/1973 LeRouax
3,766,979 A 10/1973 Petrick
3,817,326 A 6/1974 Meynier, III
3,863,667 A 2/1975 Ward
3,918,478 A 11/1975 LeRouax
3,922,780 A 12/1975 Green
3,946,806 A 3/1976 Meynier, III
3,955,622 A 5/1976 Jones
4,007,797 A 2/1977 Jeter
4,015,496 A 4/1977 Hill
4,043,389 A 8/1977 Cobb
4,057,887 A 11/1977 Jones et al.
4,119,115 A 10/1978 Carruthers
4,132,265 A 1/1979 Williams, Jr.
4,132,267 A 1/1979 Jones
4,140,041 A 2/1979 Freiau
4,215,749 A 8/1980 Dare et al.
4,220,206 A 9/1980 Van Winkle
4,240,503 A 12/1980 Holt et al.
4,253,638 A 3/1981 Troxell, Jr.
4,313,496 A 2/1982 Childs et al.
4,341,264 A 7/1982 Cox et al.
4,347,898 A 9/1982 Jones
4,372,527 A 2/1983 Rosenbauch et al.
4,392,633 A 7/1983 Van Winkle
4,416,441 A 11/1983 Van Winkle
4,437,643 A 3/1984 Brakhage, Jr. et al.
4,492,359 A 1/1985 Baugh
4,504,037 A 3/1985 Beam et al.
4,508,313 A 4/1985 Jones
4,516,589 A 5/1985 Stupak
4,516,598 A 5/1985 Stupak
4,518,144 A 5/1985 Vicic et al.
4,519,577 A 5/1985 Jones
4,523,639 A 6/1985 Howard, Jr.
4,526,339 A 7/1985 Miller
4,537,250 A 8/1985 Troxell, Jr.
4,540,046 A 9/1985 Granger et al.
4,549,349 A 10/1985 Harrison
4,550,895 A 11/1985 Shaffer
4,558,842 A 12/1985 Peil et al.
4,568,842 A 2/1986 Peil et al.
4,612,983 A 9/1986 Karr, Jr.
4,646,825 A 3/1987 Van Winkle
4,647,002 A 3/1987 Crutchfield
4,690,033 A 9/1987 Van Winkle
4,690,411 A 9/1987 Van Winkle
4,699,350 A 10/1987 Herve
4,923,005 A 5/1990 Lakey et al.
4,923,008 A 5/1990 Wachowicz et al.
4,943,031 A 7/1990 Van Winkle
4,969,390 A 11/1990 Williams, III
5,002,130 A 5/1991 Laky
5,013,005 A 5/1991 Nance
5,025,708 A 6/1991 Smith et al.
5,056,418 A 10/1991 Granger et al.
5,178,215 A 1/1993 Yenulis et al.
5,199,493 A 4/1993 Sodder
5,217,073 A 6/1993 Bruns
5,237,899 A 8/1993 Schartinger
5,360,061 A 11/1994 Womble
5,361,832 A 11/1994 Van Winkle
5,400,875 A 3/1995 Whitby et al.
5,505,426 A 4/1996 Whitby et al.
5,515,916 A 5/1996 Haley
5,566,753 A 10/1996 Van Winkle et al.
5,575,451 A 11/1996 Colvin et al.
5,575,452 A 11/1996 Whitby et al.
5,588,491 A 12/1996 Brugman et al.
5,590,867 A 1/1997 Van Winkle
5,655,745 A 8/1997 Morrill
5,662,171 A 9/1997 Brugman et al.
5,713,581 A 2/1998 Carlson et al.
5,735,918 A 4/1998 Levett et al.
5,778,918 A 7/1998 McLelland
5,833,208 A 11/1998 Lee, Jr.
5,863,022 A 1/1999 Van Winkle
5,897,097 A 4/1999 Brugman et al.
5,918,851 A 7/1999 Whitby
5,961,094 A 10/1999 Van Winkle
5,969,042 A 10/1999 Gaydos
5,975,484 A 11/1999 Brugman et al.
6,006,647 A 12/1999 Van Winkle
6,012,528 A 1/2000 Van Winkle
6,016,880 A 1/2000 Hall et al.
6,113,061 A 9/2000 Van Winkle
6,158,505 A 12/2000 Araujo
6,164,619 A 12/2000 Van Winkle et al.
6,173,770 B1 1/2001 Morrill
6,192,680 B1 2/2001 Brugman et al.
6,244,336 B1 6/2001 Kachich
6,244,560 B1 6/2001 Johnson
6,276,450 B1 8/2001 Seneviratne
6,374,925 B1 4/2002 Elkins et al.
6,484,808 B2 11/2002 Jones et al.
6,510,897 B2 1/2003 Hemphill
6,530,432 B2 3/2003 Gipson
6,601,650 B2 8/2003 Sundararajan
6,718,860 B2 4/2004 Mitsukawa et al.
6,719,042 B2 4/2004 Johnson et al.
6,742,597 B2 6/2004 Van Winkle et al.
6,834,721 B2 12/2004 Suro
6,843,463 B1 1/2005 McWhorter et al.
6,857,634 B2 2/2005 Araujo
6,964,303 B2 11/2005 Mazorow et al.
6,974,135 B2 12/2005 Melancon et al.
7,011,159 B2 3/2006 Holland
7,011,160 B2 3/2006 Boyd
7,044,430 B2 5/2006 Brugman et al.
7,051,989 B2 5/2006 Springett et al.
7,051,990 B2 5/2006 Springett et al.
7,055,594 B1 6/2006 Springett et al.
7,086,467 B2 8/2006 Schlegelmilch et al.
7,108,081 B2 9/2006 Boyadjieff
7,165,619 B2 1/2007 Fox et al.
7,195,224 B2 3/2007 Le
7,207,382 B2 4/2007 Schaeper
7,225,873 B2 6/2007 Schlegelmilch et al.
7,234,530 B2 6/2007 Gass
7,243,713 B2 7/2007 Isaacks et al.
7,270,190 B2 9/2007 McWhorter et al.
7,287,544 B2 10/2007 Seneviratne et al.
7,331,562 B2 2/2008 Springett
7,350,587 B2 4/2008 Springett et al.
7,354,026 B2 4/2008 Urrutia
7,360,603 B2 4/2008 Springett et al.
7,367,395 B2 5/2008 Springett et al.
7,367,396 B2 5/2008 Springett et al.
7,389,817 B2 6/2008 Almdahl et al.
7,410,003 B2 8/2008 Ravensbergen
7,434,369 B2 10/2008 Uneyama et al.
7,464,765 B2 12/2008 Isaacks et al.
7,487,848 B2 2/2009 Wells et al.
7,520,129 B2 4/2009 Springett
7,523,644 B2 4/2009 Van Winkle
7,673,674 B2 3/2010 Lam

(56) References Cited

U.S. PATENT DOCUMENTS

| | | | |
|---|---|---|---|
| 7,703,739 | B2 | 4/2010 | Judge et al. |
| 7,726,418 | B2 | 6/2010 | Ayling |
| 7,748,473 | B2 | 7/2010 | Wells et al. |
| 7,798,466 | B2 | 9/2010 | Springett et al. |
| 7,814,979 | B2 | 10/2010 | Springett et al. |
| 8,066,070 | B2 | 11/2011 | Springett et al. |
| 2003/0127231 | A1 | 7/2003 | Schlegelmitch et al. |
| 2004/0003919 | A1 | 1/2004 | Johnson et al. |
| 2004/0124380 | A1 | 7/2004 | Van Winkle |
| 2005/0269079 | A1 | 12/2005 | Franklin |
| 2006/0076526 | A1 | 4/2006 | McWhorter et al. |
| 2006/0113501 | A1 | 6/2006 | Isaacks et al. |
| 2006/0137827 | A1 | 6/2006 | Uneyama et al. |
| 2007/0102655 | A1 | 5/2007 | Springett |
| 2007/0137866 | A1 | 6/2007 | Ravensbergen et al. |
| 2007/0246215 | A1 | 10/2007 | Springett et al. |
| 2008/0040070 | A1 | 2/2008 | McClanahan |
| 2008/0185046 | A1 | 8/2008 | Springett et al. |
| 2008/0185143 | A1 | 8/2008 | Winters et al. |
| 2008/0189954 | A1 | 8/2008 | Lin |
| 2008/0265188 | A1 | 10/2008 | Springett et al. |
| 2008/0267786 | A1 | 10/2008 | Springett et al. |
| 2008/0286534 | A1 | 11/2008 | Springett et al. |
| 2009/0056132 | A1 | 3/2009 | Foote |
| 2009/0205838 | A1 | 8/2009 | Springett |
| 2009/0265395 | A1* | 10/2009 | Milne ..... E21B 33/0355 |
| 2010/0038088 | A1 | 2/2010 | Springett et al. |
| 2010/0152901 | A1* | 6/2010 | Judge ..... E21B 33/062 700/275 |
| 2011/0000670 | A1 | 1/2011 | Springett et al. |
| 2012/0026002 | A1* | 2/2012 | Vu ..... E21B 47/00 340/854.6 |
| 2012/0193087 | A1 | 8/2012 | Hall et al. |
| 2012/0193556 | A1 | 8/2012 | Yadav et al. |
| 2012/0197527 | A1 | 8/2012 | McKay et al. |

OTHER PUBLICATIONS

International Search Report for PCT Patent Application No. PCT/US2014/017447 dated Feb. 2, 2015, 3 pages.

Korean Office Action dated Jun. 20, 2016 for Korean Application No. 10-2015-7025443, 19 pages total (9 pages in Korean and 10 pages of English translation).

* cited by examiner

Position History

| | |
|---|---|
| 05-20 23:29:29 | Lower Outer Kill To Closed |
| 05-20 23:29:26 | Lower Inner Kill To Closed |
| 05-20 23:11:52 | Lower Outer Kill To Open |
| 05-20 23:11:46 | Lower Inner Kill To Open |
| 05-20 23:11:34 | Lower Inner Choke To Closed |
| 05-20 23:11:26 | Lower Outer Choke To Closed |
| 05-20 22:48:14 | Lower Outer Choke to Open |
| 05-20 22:47:55 | Lower Inner Choke To Open |
| 05-20 22:47:41 | Lower Inner Choke To Closed |
| 05-20 22:47:37 | Lower Outer Choke To Closed |
| 05-20 22:46:50 | Lower Outer Choke To Open |
| 05-20 22:46:31 | Lower Inner Choke To Open |
| 05-20 21:03:48 | Mud Fill Valve To Closed |
| 05-20 20:47:56 | Mud Fill Valve To Open |
| 05-20 15:15:05 | Mud Fill Valve To Closed |
| 05-20 14:59:07 | Mud Fill Valve To Open |
| 05-20 11:03:49 | Mud Fill Valve To Closed |
| 05-20 10:47:14 | Mud Fill Valve To Open |
| 05-20 10:19:52 | Lower Outer Choke To Closed |
| 05-20 10:19:49 | Lower Inner Choke To Closed |
| 05-20 09:59:05 | Lower Inner Choke To Open |
| 05-20 09:58:49 | Lower Outer Choke To Open |
| 05-20 09:58:46 | Lower Outer Kill To Closed |
| 05-20 09:58:43 | Lower Inner Kill To Open |
| 05-20 09:38:09 | Lower Inner Kill To Open |
| 05-20 09:36:44 | Lower Outer Kill To Open |
| 05-20 09:34:18 | Mud Boost Valve To Open |
| 05-20 09:32:36 | Lower Outer Kill To Closed |
| 05-20 09:32:12 | Mud Boost Valve To Closed |
| 05-20 09:31:45 | Lower Outer Kill To Open |
| 05-20 09:31:35 | Mud Boost Valve To Open |
| 05-20 09:17:32 | Mud Boost Valve To Closed |
| 05-19 23:42:41 | Lower Outer Kill To Closed |
| 05-19 23:42:41 | Lower Inner Kill To Closed |
| 05-19 23:37:28 | Lower Outer Kill To Open |
| 05-19 23:37:26 | Lower Inner Kill To Open |
| 05-19 23:37:22 | Lower Outer Choke To Closed |
| 05-19 23:37:22 | Lower Inner Choke To Closed |
| 05-19 23:34:02 | Lower Outer Choke To Open |
| 05-19 23:34:01 | Lower Inner Choke To Open |
| 05-19 23:19:41 | Lower Outer Kill To Closed |
| 05-19 23:19:39 | Lower Inner Kill To Closed |

*FIG. 6B*

776d

| Surface Feedback | | |
|---|---|---|
| HPU Accumulator Pressure | 4881 | PSI |
| HPU Manifold Pressure | 2580 | PSI |
| HPU System Hydraulic Pressure | 4901 | PSI |
| HPU Air Pressure | 125 | PSI |
| Diverter Accumulator Pressure | 2806 | PSI |
| Diverter Air Pressure | 123 | PSI |
| Diverter Packer Pressure | 571 | PSI |
| Diverter Manifold Pressure | 1514 | PSI |
| Flowline Seals Pressure | 850 | PSI |
| SlipJoint Packer Pneumatic Pressure | 89 | PSI |
| SlipJoint Packer Hydraulic Pressure | 112 | PSI |

*FIG. 7D1*

776d

| Blue Pod | | SubSea | Yellow Pod | |
|---|---|---|---|---|
| 4808 | PSI | Conduit Pressure | 4892 | PSI |
| 4964 | PSI | Pod Pilot Accumulator Pressure | 4805 | PSI |
| 97 | PSI | Supply Pressure | 3327 | PSI |
| 2974 | PSI | Pod Pilot Pressure | 2878 | PSI |
| 0 | PSI | Manifold Pilot Pressure | 1517 | PSI |
| 43 | PSI | Manifold Pressure | 1376 | PSI |
| 1423 | PSI | Upper Annular Pilot Pressure | 1453 | PSI |
| 0 | PSI | Upper Annular Pressure | 1540 | PSI |
| 1318 | PSI | Lower Annular Pilot Pressure | 1439 | PSI |
| 364 | PSI | Lower Annular Pressure | 1339 | PSI |
| 1398 | PSI | Riser Connector Pilot Pressure | 1383 | PSI |
| 8 | PSI | Riser Connector Pressure | 1478 | PSI |
| 1283 | PSI | Stack Connector Pilot Pressure | 1482 | PSI |
| 0 | PSI | Stack Connector Pressure | 1475 | PSI |
| 26 | PSI | Shear Pressure | 4826 | PSI |
| 4120 | PSI | Stack Wellbore Pressure | 0 | PSI |
| 62 | *F | Stack Wellbore Temperature | 0 | *F |
| 52 | *F | Can 1 Temperature | 51 | *F |
| 47 | *F | Can 2 Temperature | 47 | *F |
| 7 | % | Can 1 Humidity | 16 | % |
| 15 | % | Can 2 Humidity | 17 | % |

*FIG. 7D2*

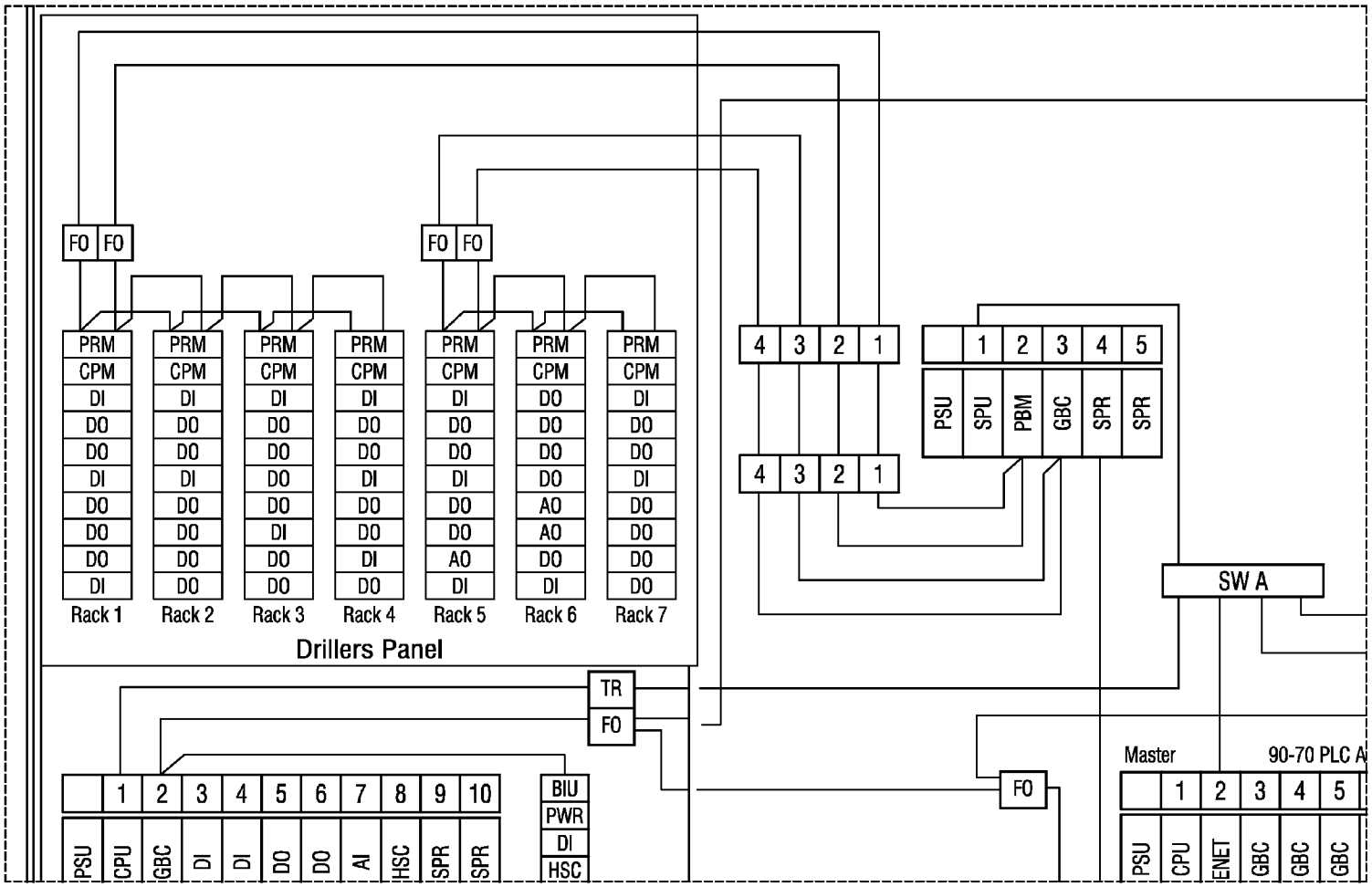
FIG. 7F1

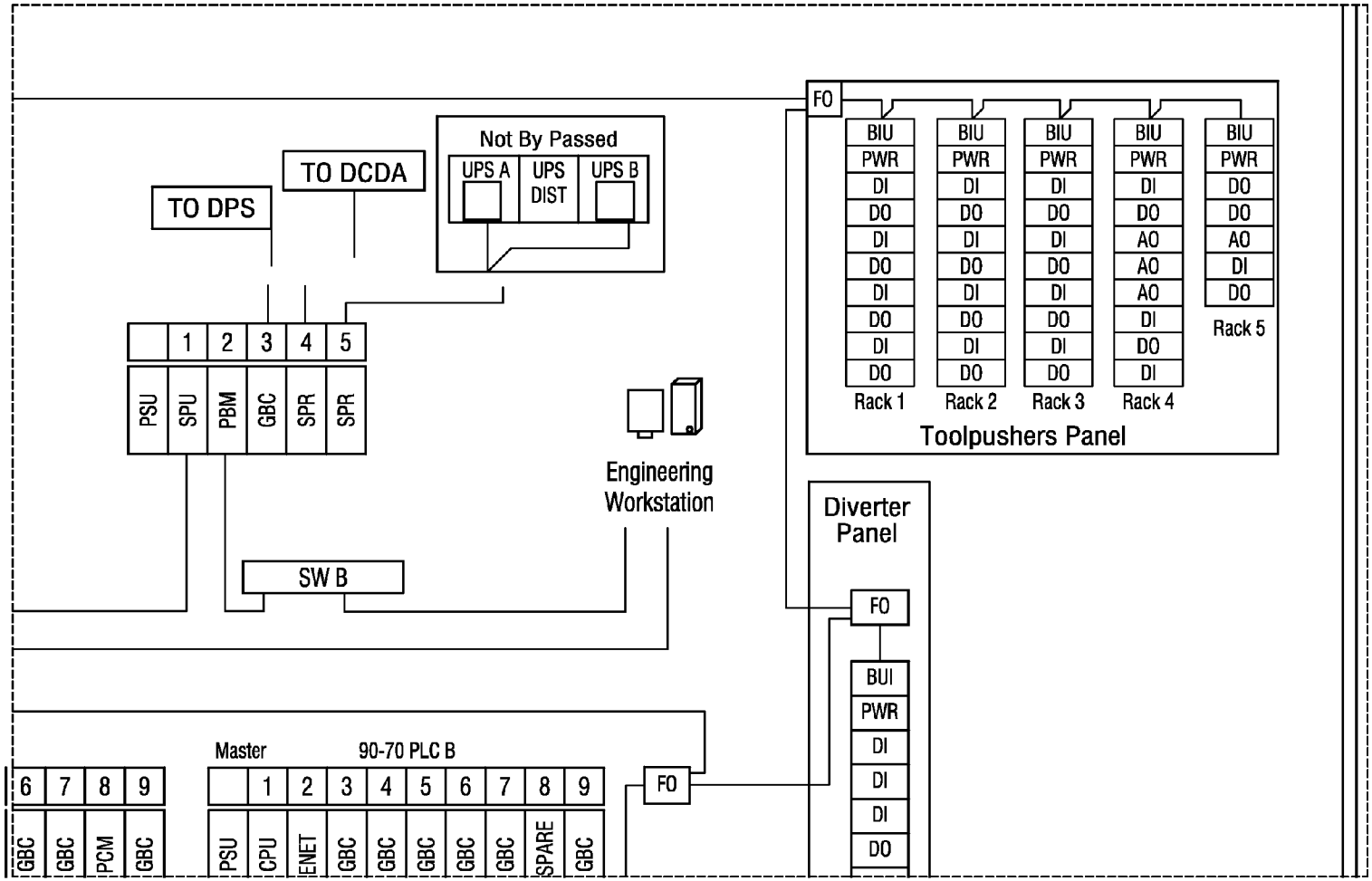
FIG. 7F2

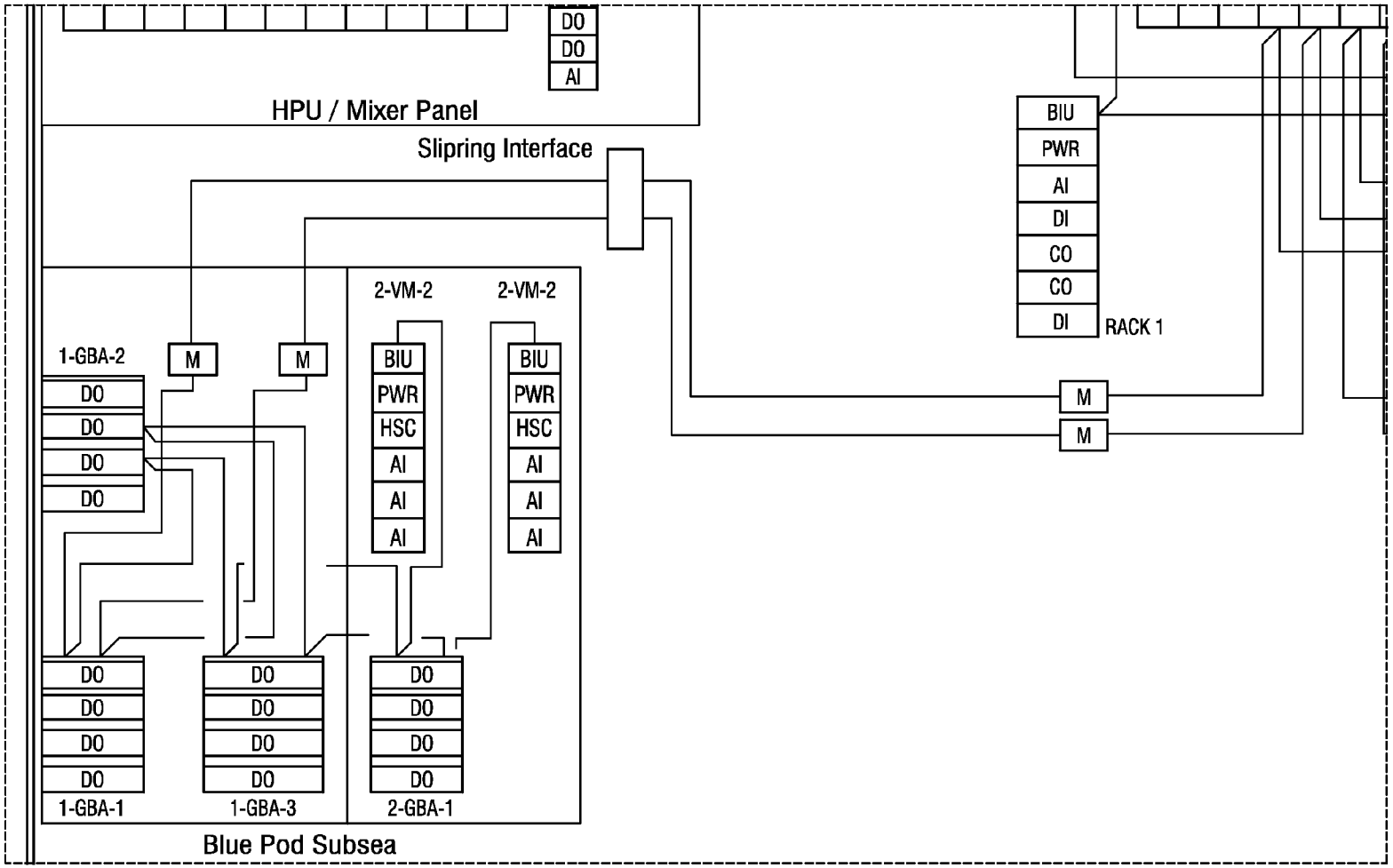
758f
FIG. 7F3

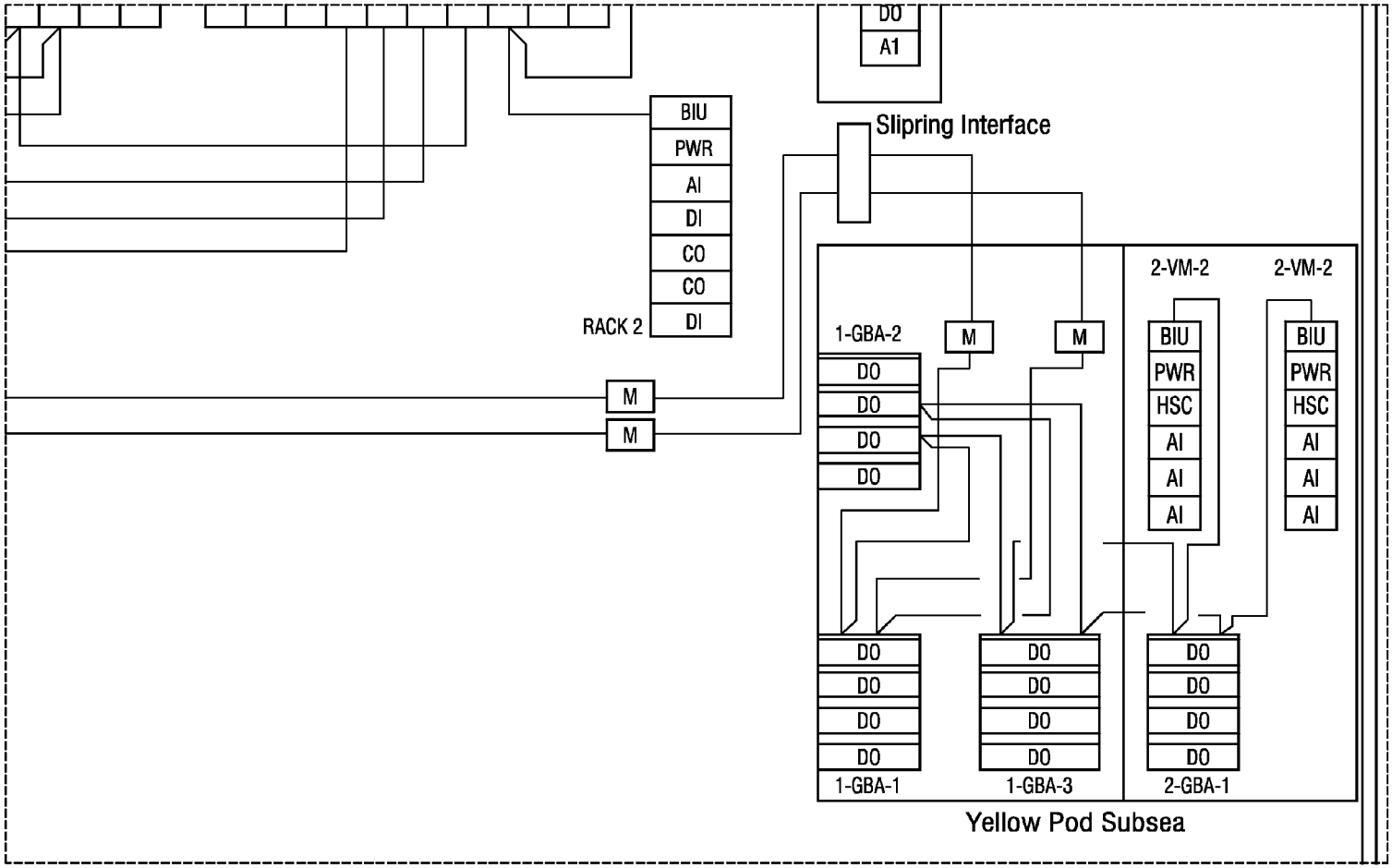
FIG. 7F4
758f

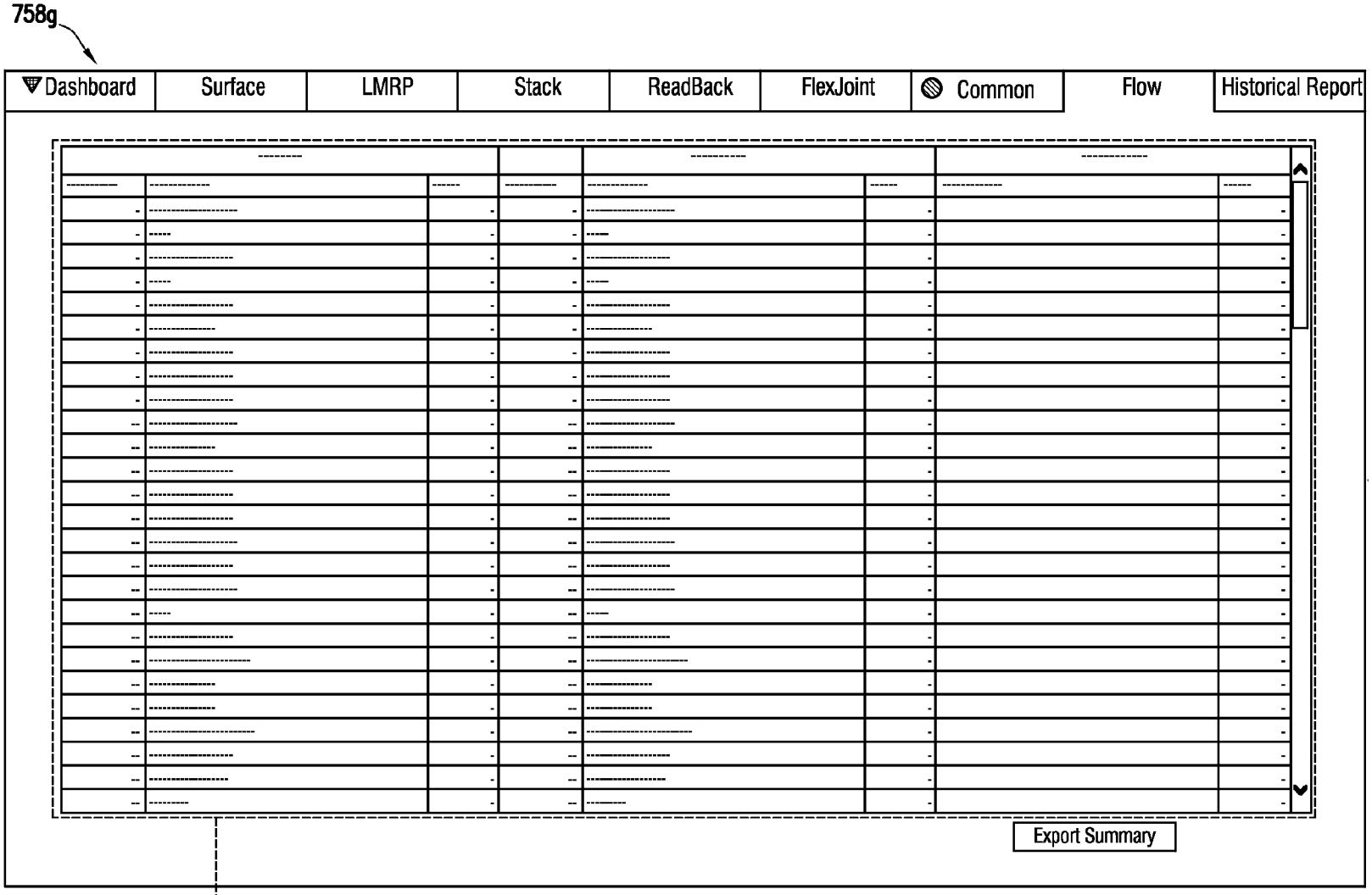
FIG. 7G1

FIG. 7G2

| Blue Pod | | | Yellow Pod | | | Rubber Goods | |
|---|---|---|---|---|---|---|---|
| Hyd/Pocket# | Function Name | Cycles | Hyd/Pocket# | Function Name | Cycles | Function Name | Cycles |
| 1 | ICS_CHK_KILL_ISO_OPN | 2 | 1 | ICS_CHK_KILL_ISO_OPN | 1 | | 0 |
| 2 | SPARE | 0 | 2 | SPARE | 0 | | 0 |
| 3 | ICS_UPR_OUT_CHK_OPN | 1 | 3 | ICS_UPR_OUT_CHK_OPN | 1 | | 0 |
| 4 | SPARE | 0 | 4 | SPARE | 0 | | 0 |
| 5 | ICS_MUD_BST_VLV_OPN | 2 | 5 | ICS_MUD_BST_VLV_OPN | 0 | | 0 |
| 6 | MID_INN_CHK_OPN | 0 | 6 | MID_INN_CHK_OPN | 0 | | 0 |
| 7 | ICS_MUD_BST_VLV_CLS | 1 | 7 | ICS_MUD_BST_VLV_CLS | 0 | | 0 |
| 8 | ICS_STK_FSC_ACC_DMP | 0 | 8 | ICS_STK_FSC_ACC_DMP | 0 | | 0 |
| 9 | ICS_INN_GAS_RLF_OPN | 1 | 9 | ICS_INN_GAS_RLF_OPN | 1 | | 0 |
| 10 | ICS_LMRP_FSC_ACC_DMP | 0 | 10 | ICS_LMRP_FSC_ACC_DMP | 0 | | 0 |
| 11 | MID_OUT_CHK_OPN | 0 | 11 | MID_OUT_CHK_OPN | 0 | | 0 |
| 12 | ICS_INN_FSC_ACC_CHG | 1 | 12 | ICS_INN_FSC_ACC_CHG | 0 | | 0 |
| 13 | ICS_LWR_INN_CHK_OPN | 1 | 13 | ICS_LWR_INN_CHK_OPN | 1 | | 0 |
| 14 | ICS_OUT_FSC_ACC_CHG | 1 | 14 | ICS_OUT_FSC_ACC_CHG | 0 | | 0 |
| 15 | ICS_CHK_KILL_STB_EXT | 1 | 15 | ICS_CHK_KILL_STB_EXT | 0 | | 0 |
| 16 | ICS_LWR_OUT_CHK_OPN | 1 | 16 | ICS_LWR_OUT_CHK_OPN | 1 | | 0 |
| 17 | ICS_CHK_KILL_STB_RET | 0 | 17 | ICS_CHK_KILL_STB_RET | 0 | | 0 |
| 18 | SPARE | 0 | 18 | SPARE | 0 | | 0 |
| 19 | ICS_OUT_GAS_RLF_OPN | 1 | 19 | ICS_OUT_GAS_RLF_OPN | 1 | | 0 |
| 20 | ICS_HK_KILL_STB_LCK_ULK | 0 | 20 | ICS_HK_KILL_STB_LCK_ULK | 0 | | 0 |
| 21 | ICS_WET_CON_EXT | 1 | 21 | ICS_WET_CON_EXT | 0 | | 0 |
| 22 | ICS_WET_CON_RET | 0 | 22 | ICS_WET_CON_RET | 0 | | 0 |
| 23 | ICS_CHK_KILL_STB_SEC_ULK | 0 | 23 | ICS_CHK_KILL_STB_SEC_ULK | 0 | | 0 |
| 24 | ICS_RST_CON_SEC_ULK | 0 | 24 | ICS_RST_CON_SEC_ULK | 0 | | 0 |
| 25 | ICS_STK_CON_SE_ULK | 0 | 25 | ICS_STK_CON_SE_ULK | 0 | | 0 |
| 26 | EHBS_LOHP | 0 | 26 | EHBS_LOHP | 0 | | 0 |

| Cycle Occurence | Cycle Duration (sec) | FLow (gal) | Concurrent Function |
|---|---|---|---|
| 08/22/2013 15:39:05 | 863257.25 | 0.7 | ICS_UPR_ANN_CLS_IND |
| 08/22/2013 15:39:05 | 636226.14 | 0.0 | ICS_UPR_ANN_CLS_IND |
| 08/30/2013 10:50:57 | 50 | 66.0 | ICS_UPR_ANN_CLS_IND |
| 08/30/2013 10:50:51 | 50 | 66.0 | ICS_UPR_ANN_CLS_IND |

BLOWOUT PREVENTER MONITORING SYSTEM AND METHOD OF USING SAME

CROSS-REFERENCE TO RELATED APPLICATIONS

This patent application claims priority to U.S. Provisional Application No. 61/767,685 filed on Feb. 21, 2013, the entire contents of which are hereby incorporated by reference herein.

BACKGROUND

This present disclosure relates generally to techniques for performing wellsite operations. More specifically, the present disclosure relates to techniques for preventing blowouts involving, for example, monitoring blowout preventers.

Oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Downhole tubular devices, such as pipes, certain downhole tools, casings, drill pipe, liner, coiled tubing, production tubing, wireline, slickline, or other tubular members positioned in the wellbore, and associated components, such as drill collars, tool joints, drill bits, logging tools, packers, and the like, (referred to as 'tubulars' or 'tubular strings') may be positioned in the wellbore to enable the passage of subsurface fluids to the surface.

Leakage of subsurface fluids may pose an environmental threat if released from the wellbore. Equipment, such as blow out preventers (BOPs), may be positioned about the wellbore to form a seal about a tubular therein to prevent leakage of fluid as it is brought to the surface. BOPs may have selectively actuatable rams or ram bonnets, such as pipe rams or shear rams, that may be activated to seal and/or sever a tubular in a wellbore. Some examples of BOPs for severing tubulars are provided in U.S. Patent/Application No. 20110000670; U.S. Pat. Nos. 7,814,979; and 7,367,396. In some cases, it may be necessary to maintain the BOP, for example, when the BOP does not perform as desired or when a part fails on a BOP.

SUMMARY

In at least one aspect, the disclosure relates to a blowout preventer unit for monitoring a blowout preventer at a wellsite. The blowout preventer is activatable to form a seal to prevent leakage of the fluid produced from subsurface formations. The blowout preventer unit includes a plurality of wellsite databases operatively connectable to the wellsite to receive wellsite data therefrom and having communication links therebetween, at least one control unit operatively connectable to the plurality of wellsite databases to selectively divert the wellsite data therebetween via the communication links and comprising a processor to determine blowout preventer parameters from the diverted wellsite data, and blowout preventer outputs operatively coupled to the plurality of wellsite databases. The blowout preventer outputs are accessible by users and include blowout preventer dashboards to selectively display the blowout preventer parameters whereby blowout preventer conditions are viewable by the users.

The wellsite data may include ram block data, and the blowout preventer parameters comprise ram block parameters, with the blowout preventer dashboards displaying the ram block parameters. The ram block parameters may include force displacement, ram cycle, pressure, temperature, position, fluid flow, equipment, rubber displacement, and/or historical data. The wellsite databases may include a blowout preventer database and a plurality of subdatabases. The wellsite databases may include a blowout preventer database operatively connected to the plurality of subdatabases by the communication links. The subdatabases may include a dashboard database, a force displacement database, a cycle database, an equipment database, and/or a report database.

The dashboards may be operatively connected by the communication links to the dashboard database, the force displacement database, and the cycle database. The blowout preventer outputs may include an equipment output. The equipment output may be operatively connected by the communication links to the dashboard database, the force displacement database, the cycle database, and the equipment database. The blowout preventer outputs may include a report manager, the report manager operatively connected by the communication links to the report database. The users may provide input to wellsite databases. The dashboards may include a high level health and communication tool. The blowout preventer outputs may include at least one of an equipment output and a report output. The dashboards may display indicators comprising pressure, temperature, force displacement, and rubber displacement. The dashboard includes displays of at least one of surface equipment, low marine riser package, stack, readback, flexjoint, common, force displacement, and flow.

In another aspect, the disclosure relates to a monitoring system for at a wellsite. The wellsite produces fluid from subsurface formations. The monitoring system includes blowout preventer activatable to form a seal to prevent leakage of the fluid and a blowout preventer unit operatively connectable to the blowout preventer. The blowout preventer s activatable to form a seal to prevent leakage of the fluid produced from subsurface formations. The blowout preventer unit includes a plurality of wellsite databases operatively connectable to the wellsite to receive wellsite data therefrom and having communication links therebetween, at least one control unit operatively connectable to the plurality of wellsite databases to selectively divert the wellsite data therebetween via the communication links and comprising a processor to determine blowout preventer parameters from the diverted wellsite data, and blowout preventer outputs operatively coupled to the plurality of wellsite databases. The blowout preventer outputs are accessible by users and include blowout preventer dashboards to selectively display the blowout preventer parameters whereby blowout preventer conditions are viewable by the users.

The monitoring system may also include an interface operatively connecting the users to the blowout preventer unit. The interface may include a computer to display the dashboards to the user and to receive input from the user. The monitoring system may also include a communication link between the blowout preventer unit and the blowout preventer, a surface unit at the wellsite, and/or wellsite sensors operatively connected to the blowout preventer to collect data therefrom. The wellsite sensors may be operatively connected to the plurality of databases to pass data therebetween.

Finally, in another aspect, the disclosure relates to a method of monitoring a blowout preventer at a wellsite. The blowout preventer is activatable to form a seal to prevent leakage of the fluid produced from subsurface formations. The method involves operatively connecting a blowout preventer unit to a blowout preventer at the wellsite (the blowout preventer unit comprising a plurality of wellsite databases, at least one control unit, and blowout preventer outputs), selectively passing wellsite data between the wellsite and one or more of the plurality of wellsite databases via communication links, determining blowout preventer parameters from the wellsite data received by the one or more of the plurality of wellsite databases, and providing blowout preventer outputs to users, the blowout preventer outputs comprising blowout preventer dashboards displaying the determined blowout preventer parameters.

The blowout preventer parameters may be ram block parameters and the providing may involve displaying ram block parameters to the user over time such that changes in ram block operation may be determined. The method may also involve collecting the wellsite data from the wellsite, the wellsite data comprising blowout preventer data, determining maintenance schedules based on the blowout preventer parameters, generating reports based on the wellsite data, alerting the user when the blowout preventer parameters are out of range, receiving input from the users and implementing wellsite operations based on the input, analyzing the wellsite data, generating blowout preventer outputs based on the analyzed data, communicating the blowout preventer outputs to users at a plurality of locations in real time, integrating wellsite data from the plurality of locations, updating the blowout preventer outputs based on the integrated data, and/or adjusting blowout preventer operations at the wellsite in real time based on the updated blowout preventer outputs. The determining may involve aggregating and sorting the wellsite data.

BRIEF DESCRIPTION OF THE DRAWINGS

A more particular description of the disclosure, briefly summarized above, may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

FIGS. 6A and 6B are schematic diagrams depicting a BOP dashboard.

FIGS. 7A-7D, 7D1-7D2, 7E-7F, 7F1-7F4, 7G1-7G2, and 7H are schematic diagrams depicting various detailed BOP dashboards.

DETAILED DESCRIPTION OF THE INVENTION

The description that follows includes exemplary apparatus, methods, techniques, and/or instruction sequences that embody techniques of the present subject matter. However, it is understood that the described embodiments may be practiced without these specific details.

Blowout preventers (BOPs) may be positioned about a wellsite to provide a seal thereabout, for example, during a blowout. To detect and/or prevent failures, it may be desirable to monitor various portions of the wellsite and/or BOP. A BOP monitoring system is provided to measure various BOP parameters and detect potential BOP anomalies that may indicate a problem in the operation of the BOP. For example, BOP parameters, such as the amount of rubber in a ram, pressures, forces, time, etc., may be measured and analyzed to determine whether the BOP is performing properly.

The BOP monitoring system may include or be coupled to sensors, processors, controllers, and other devices to measure, analyze, report, adjust and/or otherwise interact with the BOP and/or wellsite. The BOP monitoring system may also communicate with one or more on or offsite locations. Real time monitoring may be provided to allow continuous feedback to control BOP and/or other operations.

Figure 1:
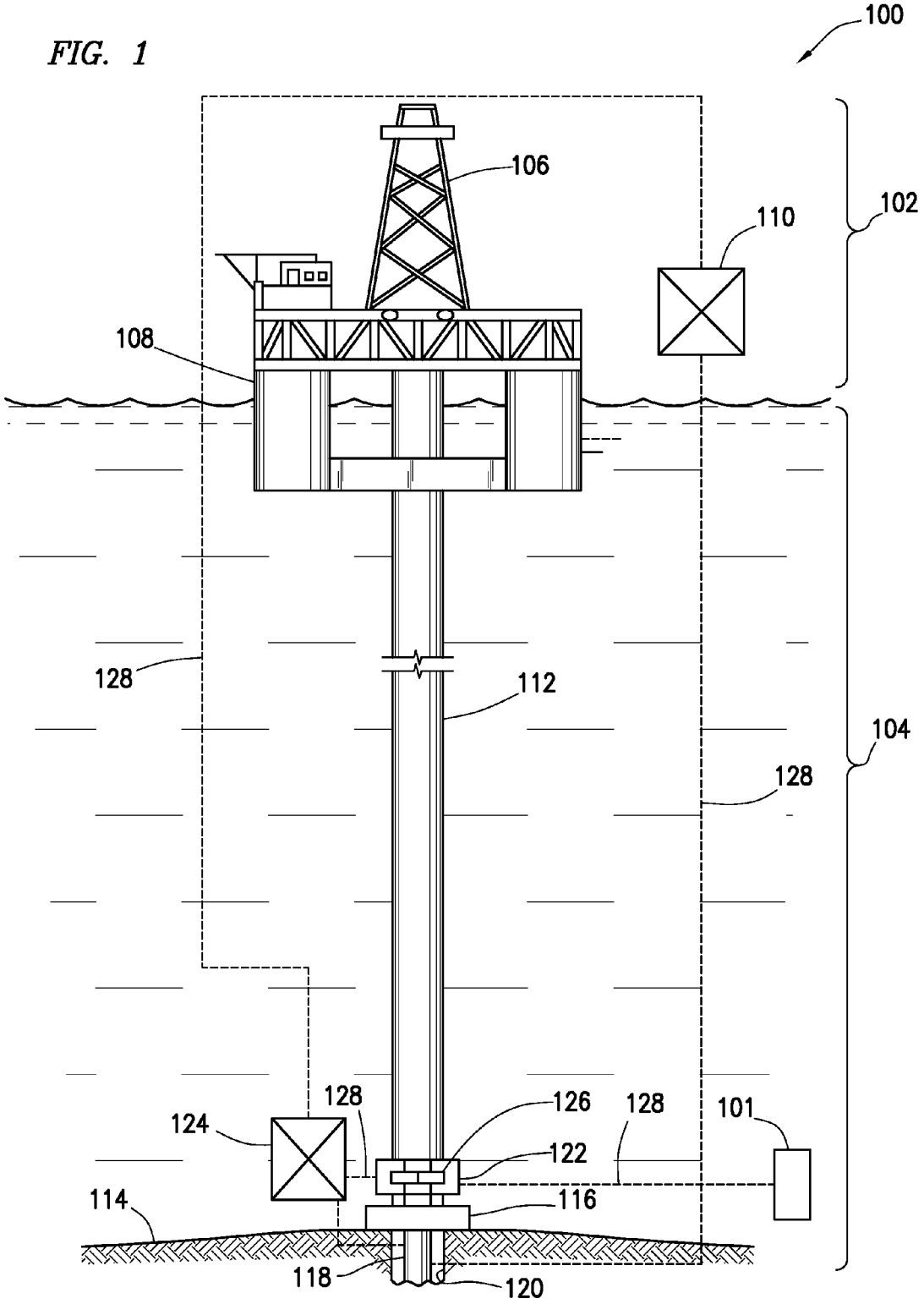
FIG. 1 depicts a schematic view of an offshore wellsite having a blowout preventer (BOP) and a BOP monitoring system.

FIG. 1 depicts an offshore wellsite 100 with a BOP monitoring system 101. While an offshore wellsite is depicted, the wellsite may be land based. The wellsite 100 has a surface system 102 and a subsea system 104. The surface system 102 may include a rig 106, a platform 108 (or vessel), and a surface unit 110. The surface unit 110 may include one or more units, tools, controllers, processors, databases, etc., located at the platform 108, on a separate vessel, and/or near to or remote from the wellsite 100.

The subsea system 104 includes a conduit 112 extending from the platform 108 to a sea floor 114. The subsea system 104 further includes a wellhead 116 with a tubular 118 extending into a wellbore 120, a BOP 122 and a subsea unit 124. The BOP 122 has a ram assembly 126 for shearing and/or sealing to seal the wellbore 120.

The surface system 102 and subsea system 104 may be provided with one or more control units, such as the surface unit 110 and/or the subsea unit 124, located at various locations to control the surface system 102 and/or the subsea systems 104. Communication links 128 may be provided for communication between the units and various parts of the wellsite 100.

The BOP 122 may be coupled to the BOP monitoring system 101 to monitor BOP operations. The BOP monitoring system 101 may be coupled to the BOP 122 and/or other portions of the wellsite 100 and/or offshore locations to collect data, communicate with various locations, measure parameters, analyze results, generate reports and/or adjust operations as will be described more fully herein. The BOP monitoring system 101 may be in communication with the BOP 122, for example, via the units 110, 124 and/or communication links 128. The BOP monitoring system 101 may be located on or off the wellsite 100. While the BOP monitoring system 101 is depicted as being coupled to the BOP 122 via communication link 128, the BOP monitoring system 101 may be incorporated into one or more of the control units 110, 124, the surface system 102, the downhole system 104, and/or other locations. Sensors may optionally be provided as part of the BOP monitoring system 101 or be coupled thereto for providing information.

Figure 2:
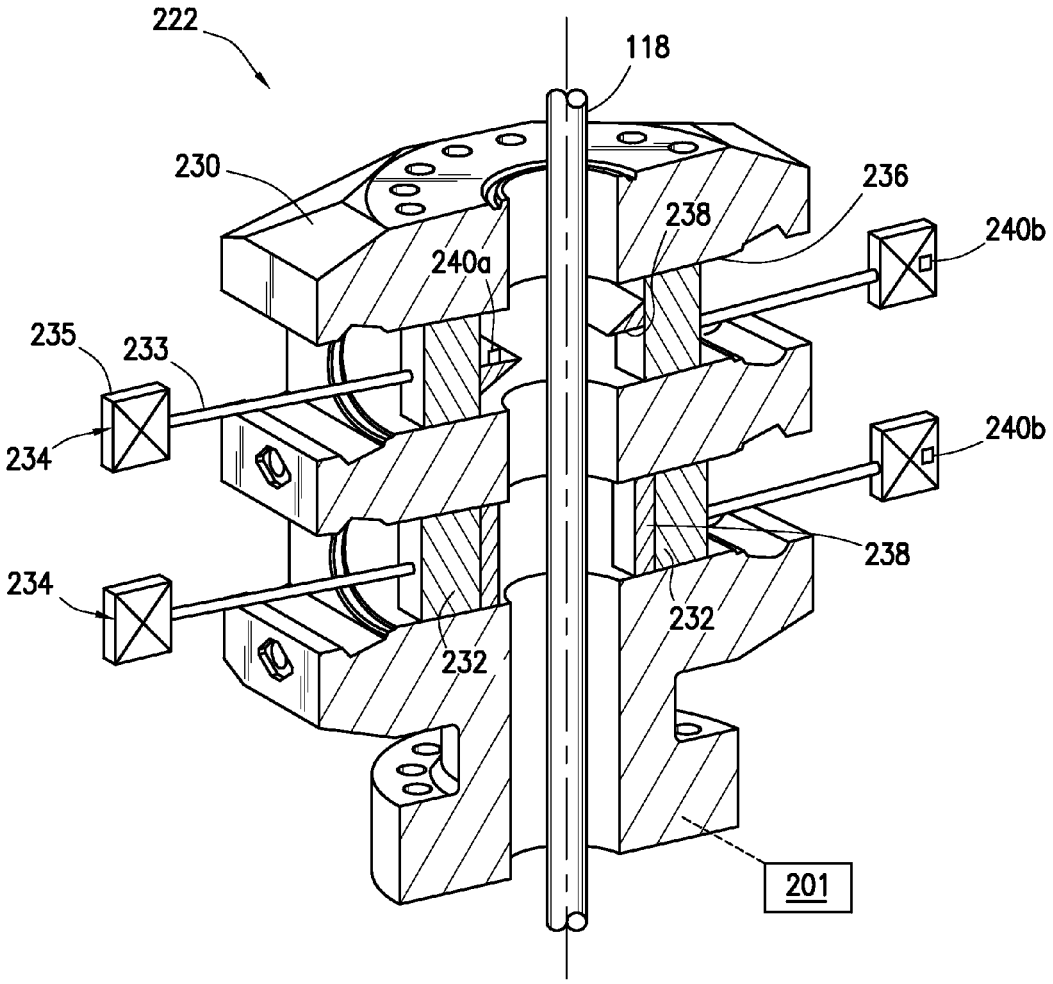
FIG. 2 is a vertical cross-sectional view of a BOP.

FIG. 2 depicts an example BOP 222 usable as the BOP 122 of FIG. 1. The BOP 222 includes a housing 230 with multiple rams 232 movably positionable therein by actuators 234. The actuators 234 may include a ram rod 233 and cylinder 235 for selectively extending and retracting the rains 232. The tubular 118 extends through the housing 230.

The rams 232 are positionable in passage 236 of the housing and selectively movable into engagement with the tubular 118 for sealing and/or severing the tubular 118. The actuators 234 may be selectively activated by units (e.g., 110, 124 of FIG. 1). In some cases, the rams 232 may extend for engagement within the BOP 222 without contact with the tubular 118 to form a seal about a wellhead connected to the BOP 222.

The rams 232 have seals 238 therein for forming a seal. The seals 238 may be made of a rubber and/or elastomeric material that is movable as the rams 232 move relative to the tubular 118. Sensors, such as seal sensor 240 a and actuator sensor 240 *b*, may be positioned about the BOP 222 for measuring BOP parameters, such as pressure, temperature, position, force displacement, ram cycle, valve pressure, fluid flow, equipment, rubber displacement, historical data, and/or other parameters. These measured parameters may provide information about operation of the BOP 222, such as whether the BOP 222 is functioning properly and/or whether a seal may be properly established about the tubular 118. A BOP monitoring system 201 (which may be the same as the BOP monitoring system 101 of FIG. 1) is coupled to the BOP 222 for receiving data therefrom, for example, from sensors 240 *a,b*.

Sensors 240*a* may be positioned about the BOP ram 232 to monitor performance of the BOP seal 238. For example, as the rubber of the BOP seal 238 wears, the amount of rubber in the BOP seal 238 may vary. Variations in the amount of rubber may be detected by sensors 240*a* and monitored by the BOP monitoring system 201 at various intervals to determine, for example, if there is a problem with the system. The rubber in the BOP seal 238 may discharge from the BOP ram 232 in a detectable amount.

Sensors 240*b* may also be provided about the BOP rams 232 to monitor performance of the BOP ram 232 and actuator 234. For example, the number of cycles or engagements, the amount of force and/or time needed to drive the ram 232 with the rod 233 and cylinder 235 of the actuator may be measured by sensors 240*h*, and analyzed by the BOP monitoring system 201 to indicate potential failure thereof. A force curve may be plotted to depict the force used to actuator the ram 232 into position about the tubular 118. Changes to the force curve may be examined to determine if wear or failure may occur.

Figure 3:
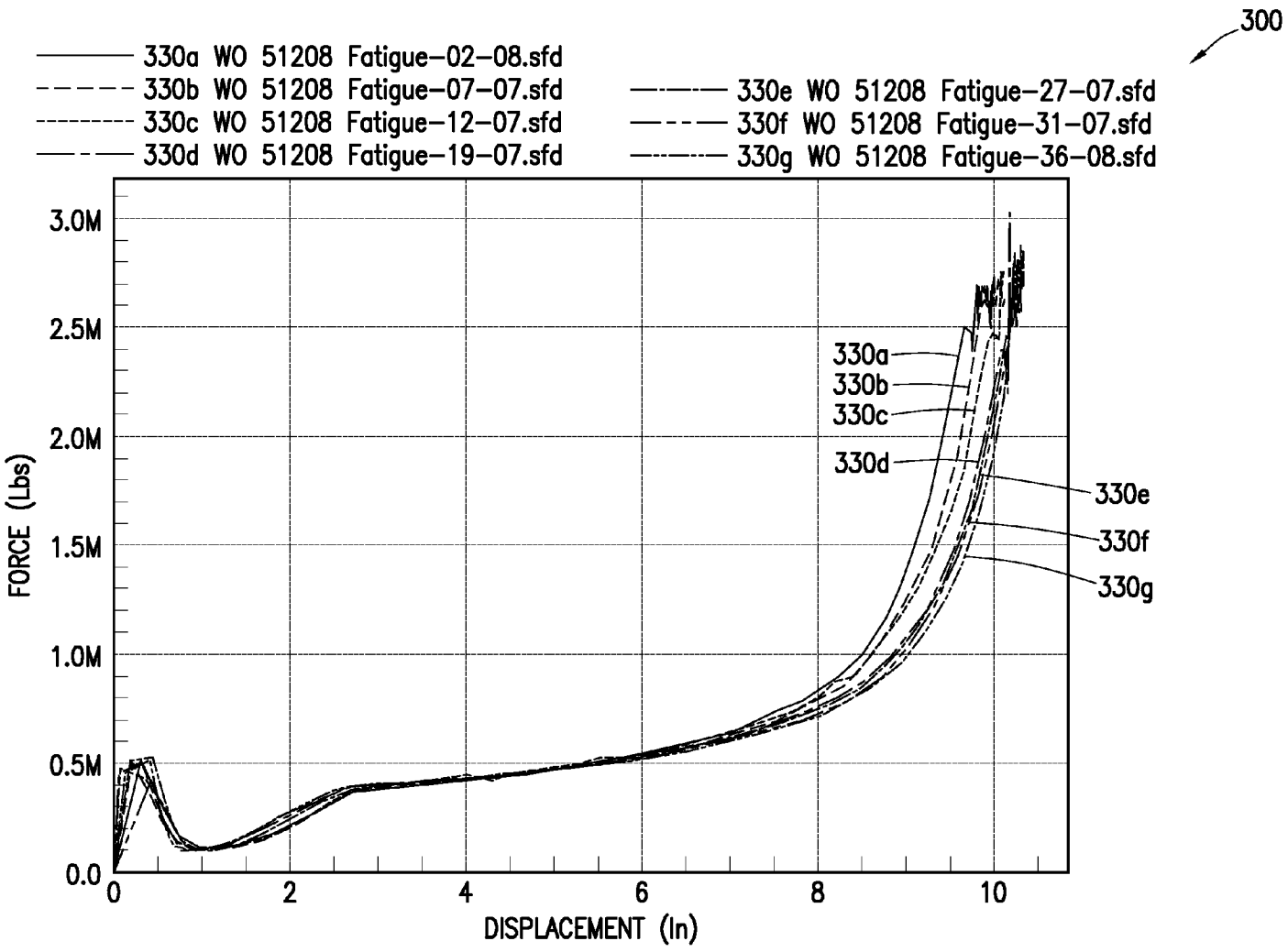
FIG. 3 is a graph depicting a force displacement curve of a BOP.

FIG. 3 shows an example graph 300 depicting a force curve of a BOP, such as BOP 222 of FIG. 2. The graph 300 plots force F (y-axis) versus displacement δ (x-axis) for rams of a BOP. Multiple measurements over time are generated and depicted as lines 333*a-g*, respectively. The lines 333*a-g* show a gradual shift in the displacement along the x-axis. This shift may indicate an increase in pressure and delay over time, which may indicate wear on the BOP. This information may be used to determine, for example, if maintenance or operational adjustments may be required. This information may be gathered, analyzed and/or fed back to the BOP 222 via the BOP monitoring system 201 and/or the control units (e.g., 110, 124 of FIG. 1). This information may be used by an operator or technical teams to make decisions. In some cases, the information may automatically be fed back to the control units to make adjustments in real time or as needed.

Figure 4:
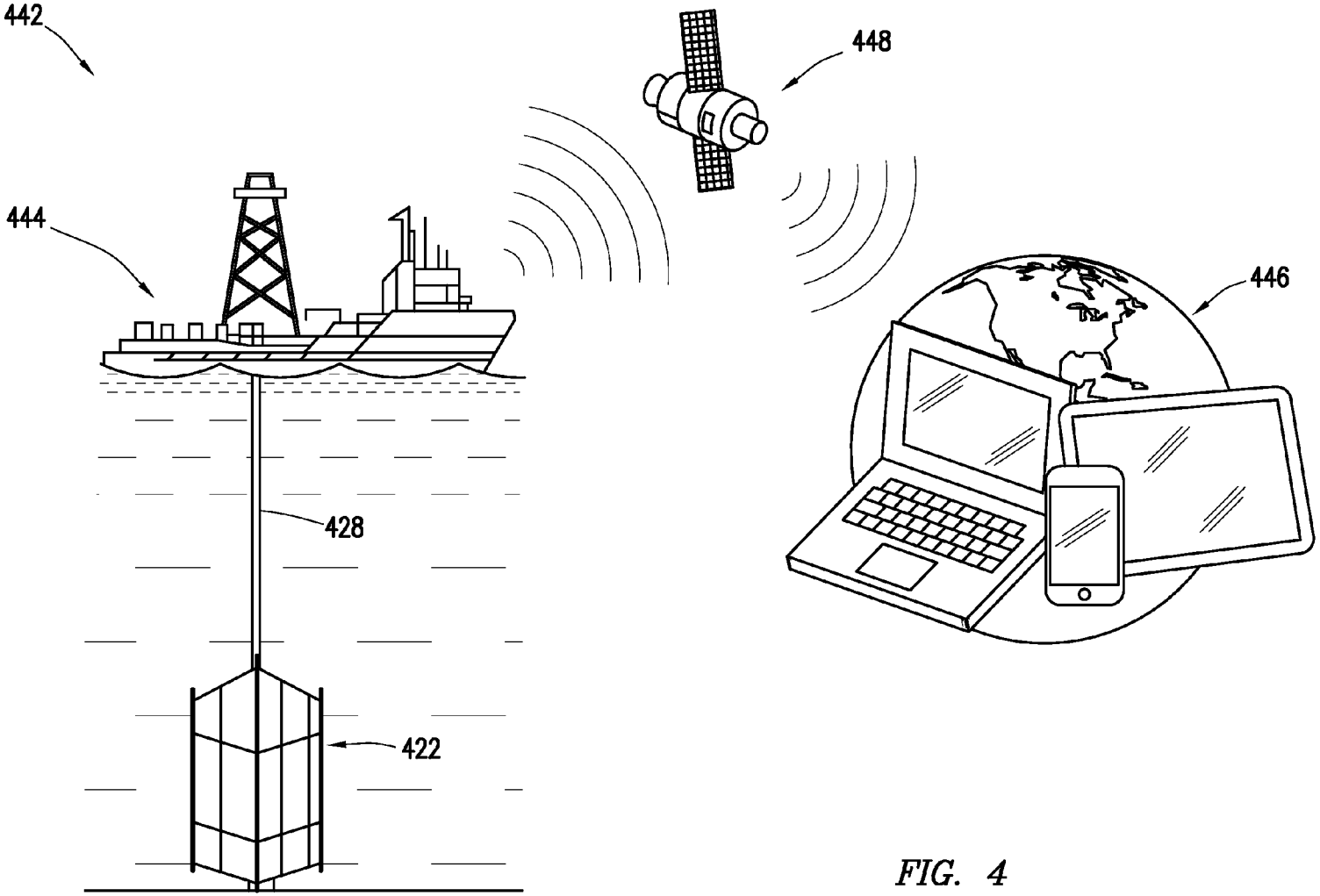
FIG. 4 is a schematic view of a BOP communication system.

FIG. 4 depicts an example communication system (or network) 442 for communicating BOP information between various locations. As shown in FIG. 4, a BOP 422 may be communicatively coupled via the communication system 442 to one or more on or offsite locations. The BOP 422 is coupled to a surface vessel 444 using, for example, a communication link 428. This communication link may be similar to the communication link 128 between the BOP 122 and surface unit 110 of FIG. 1. The communication link 428 may be wired or wireless via various communication devices for passing signals therebetween. For example, the surface vessel 444 is depicted as being coupled to an offsite location 446 via a satellite 448. This example shows the communication network 442 between the BOP 422 and an onsite vessel 444 and an offsite location 446. One or more communication links may be provided between the BOP 422 and one or more locations, such as onsite, offsite and other locations. The communication links may be provided to allow one or more individuals at one or more locations to communicate concerning the BOP 422.

Figure 5A:
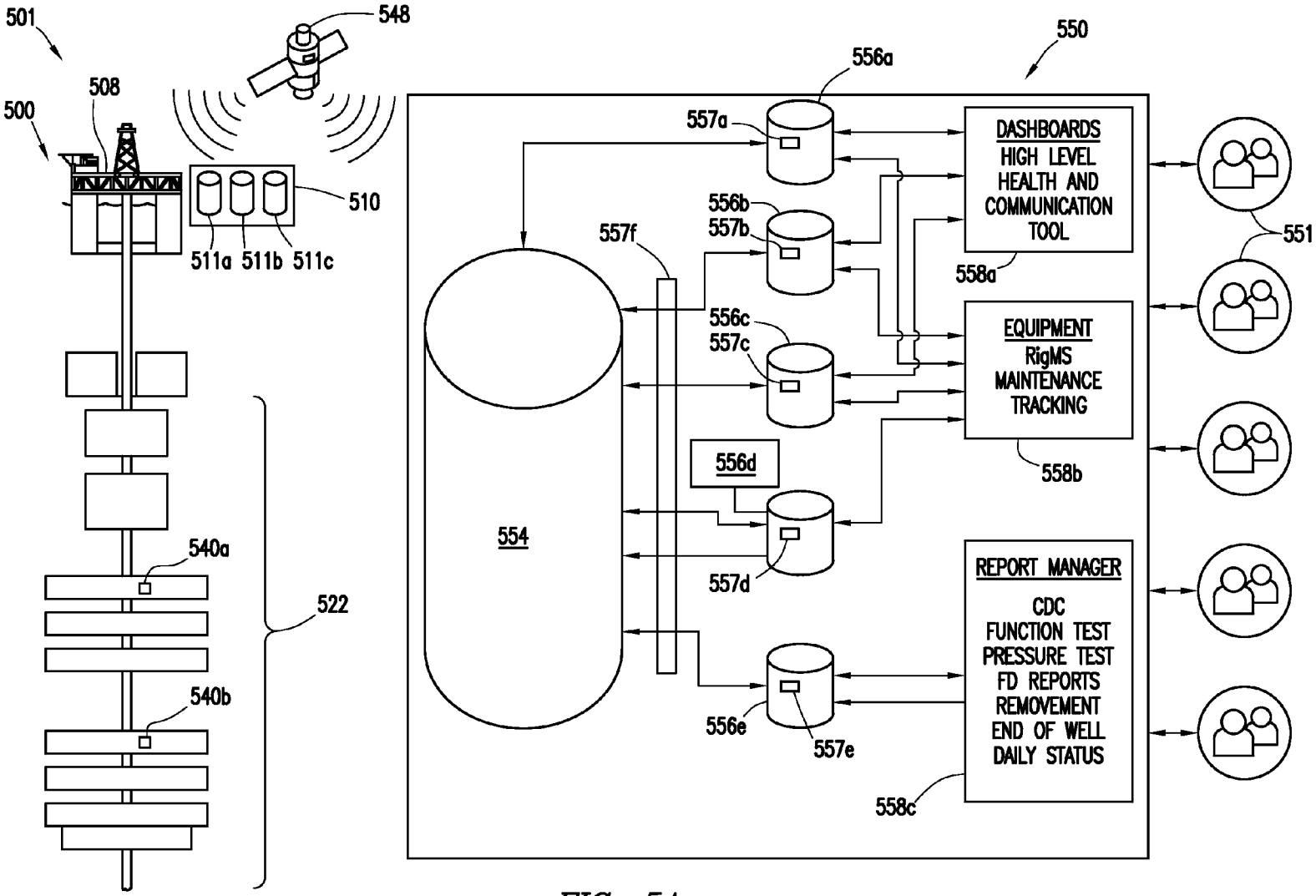
FIG. 5A is a schematic view of a BOP monitoring system.

FIG. 5A shows a BOP monitoring system 501 of a wellsite 500. The wellsite 500 includes a BOP 522 disposed below a platform 508. The BOP 522 may be similar to the BOP 122 of FIG. 1 and/or the BOP 222 of FIG. 2. The wellsite 500 may have sensors 540*a,b* coupled to the BOP 522. The wellsite 500 also has a surface unit 510 with databases 511*a-c* for collecting wellsite data.

Data may be collected from the BOP monitoring system 501 and saved on a historian that resides at the wellsite. The databases 511*a-c* may be, for example, a rig side, an equipment (e.g., RIGMS™), and a blackbox database (e.g., BLACKBOX SR™), respectively. The blackbox database may be a hardened memory module that resides on the rig to store data from the BOP monitoring system 501 and/or wellsite 500 for post disaster analysis. The RIGMS™ and BLACKBOX SR™ are commercially available from NATIONAL OILWELL VARCO™ (see: www.nov.com). One or more sensors, control units, databases, processors, computers and other devices may be provided at the wellsite for gathering data concerning the wellsite. Various controllers, transceivers or other devices may be provided about the wellsite to communicate the data and/or control the wellsite operations.

As shown in this view, the BOP monitoring system 501 includes a communication link, such as satellite 548, and a BOP unit 550. The satellite 548 provides communication between the wellsite 500 and the BOP unit 550. The satellite 548 may be used to receive data from the wellsite, such as data collected by the sensors 540*a,b* and/or the surface unit 510. The BOP unit 550 is depicted as being offsite, but could optionally be partially or wholly onsite or offsite. The BOP unit 550 is also depicted as being linked to the wellsite 500 by the satellite 548, but one or more various communication links may be used.

The BOP unit 550 includes a BOP database 554, BOP subdatabases 556*a-e* and BOP outputs 558*a-c*. The BOP database 554 receives data concerning the BOP 522 and/or the wellsite 500. The BOP database 554 may receive measured data from sensors 540*a, b*, historical data, data entry, and/or other data. Part or all of the data in the database 554 may be diverted to one or more of the BOP subdatabases 556*a-e*. The BOP subdatabases 556*a-e* include a dashboard subdatabase 556*a*, a force displacement subdatabase 556*b*, a cycle subdatabase 556*c*, an equipment (or RIGMS™) subdatabase 556*d*, and a report subdatabase 556*e*. One or more databases and outputs may be connected to various aspects of the BOP 522 to receive data concerning the BOP 522 and/or to determine if changes or predetermined conditions exist.

Data is selectively diverted between the BOP subdatabases 556*a-e* and each of the BOP outputs 558*a-c*. The BOP outputs 558*a-c* include a dashboard output 558*a*, an equipment output 558*b* and a report output 558*c*. The BOP databases 556*a-e* receive and manipulate the data and send the data to each of the BOP outputs 558*a-c*. The databases may selectively divert data to certain databases and/or outputs to manipulate the data. For example, the data may be sorted for combination and analysis. Data may pass between various portions of the BOP monitoring system 501 as indicated by the arrows.

The databases may also have various processors, controllers, communication devices or other devices for performing various functions, such as calculations, analysis, transfers and other data manipulation. For example, the BOP subdatabases 556*a-e* may each have a BOP control unit 557 *a-e* and/or be operatively connectable to one or more BOP control units 557*f* to selectively divert, control, analyze, combine and/or otherwise manipulate the data diverted to one or more of the BOP subdatabases 556*a-e*. One or more of the BOP control units 557*a-f* may be used to selectively pass the data between the BOP subdatabases 556*a-e* and/or the BOP outputs 558*a-c*. The BOP control units 557*a-f* may also be used to selectively display the data on the BOP outputs 558*a-c* as desired for use and/or access by the users 551.

The BOP subdatabases 556*a-e* and/or BOP control units 557*a-f* may be used to generate information and provide various alarms to alert users of out of tolerance conditions. The alarms may be grouped in logical zones and presented to users 551 via the various outputs 558*a-c*, such as on the dashboard 558*a* to help quickly identify the critical nature of any individual component alarm. These interactive databases and screens allow users to see relationships between alarms and events in an effort to determine overall BOP health.

The dashboard subdatabase 556*a* may be used to collect information about a high level overview of the health of the BOP system, such as pertinent analog data, position data, position history, alarm and event report, and heath straps.

Force displacement subdatabase 556*b* collects data concerning movement of the BOP rams. This data may include, for example, flow totalizer and pressure transmitter data. Other BOP data may also be included, such as pressure, temperature, position, force displacement, ram cycle, valve pressure, fluid flow, equipment, rubber displacement, historical data, and/or other wellsite data. This data may be used to evaluate the operation of the BOP 522, such as the distance of equipment (e.g., ram piston) travel. This information may be run through a calculation to determine the duration of a given cycle, and to confirm American Petroleum Institute (API) guidelines can be adhered to (e.g., to allow for audit on performance). The energy stored in rubber goods, such as annular elements and ram block seals, may also be determined. Force curves may be generated from the data provided. By measuring the delta in slope for each force curve, a prediction may be made (automatically or manually) concerning potential component failure.

Cycle subdatabase 556*c* manages cycle counts from each valve in the BOP system. Flow during cycle and pressure during cycle may also be recorded. This cycle data set may be stored and associated with each individual cycle. Cycle subdatabase 556*c* may also act as a holding area for data for equipment subdatabase 556*d*.

Equipment subdatabase 556*d* tracks equipment parameters, such as asset usage. Work orders may be automatically or manually generated based on how they are configured. For example, subdatabases 556*a,b,c* can feed data into equipment subdatabase 556*d* with historical, usage, and alarm data. Equipment subdatabase 556*d* can have predetermined setpoints/limits that instigate a work order to be generated and maintenance performed. Inventory locations and stocking limitation may also be tracked as they interact with the work order.

Report subdatabase 556*e* allows an end user to access data from subdatabases 556*a-d*. The accessed data aggregates specific points, and generates daily and instant reports based on alarm and event information. The reports may be used to provide alerts to internal and/or external users. Such reports and/or alerts may indicate that an activity has occurred, or needs to occur. Ad-hoc reports may also be provided.

As shown, dashboard subdatabase 556*a*, force displacement subdatabase 556*b*, cycle subdatabase 556*c*, and equipment subdatabase 556*d* each exchange information with users 551 via the high level health and communication tool dashboard output 558*a* and equipment output 558*b*. The report output 558*c* exchanges data with BOP database 554 via report subdatabase 556*e*. The data and inputs may be selectively sorted, presented, analyzed and/or processed by the BOP unit 550. The data may be diverted based on predetermined classifications and/or criteria. The data may be selectively combined using predetermined settings for analysis and/or presentation.

The BOP outputs 558*a-c* may generate displays from the dashboard output 558*a*. The outputs 558*a-c* may include software and/or hardware, such as monitors, inputs (e.g., keyboards, mice, microphones, etc.), processors, computers, communication links (e.g., Ethernet, wireless, cables, wired, etc.) usable by users 551. One or more of the BOP tools may be used to generate outputs 558. The dashboard output 558*a* may include a high level health and communication tool. The dashboard output 558*a* may be used to generate displays for the user. The outputs 558 may be used to display various parameters in text and/or graphical form. The displays may be selectively adjusted as needed for user viewing.

The BOP monitoring system 501 provides the outputs 558*a-c* for receipt by one or more of the users 551 at one or more locations. This information may be used to permit various users onsite and offsite to collaborate on the information being received. The various users 551 may be accessed to provide support, data interpretation, analysis and decision-making. Inputs from the users 551 may be fed into the databases 554, 556*a-e* and/or the outputs 558*a-c* to further refine the analysis and the outputs 558*a-c*.

Figure 5B:
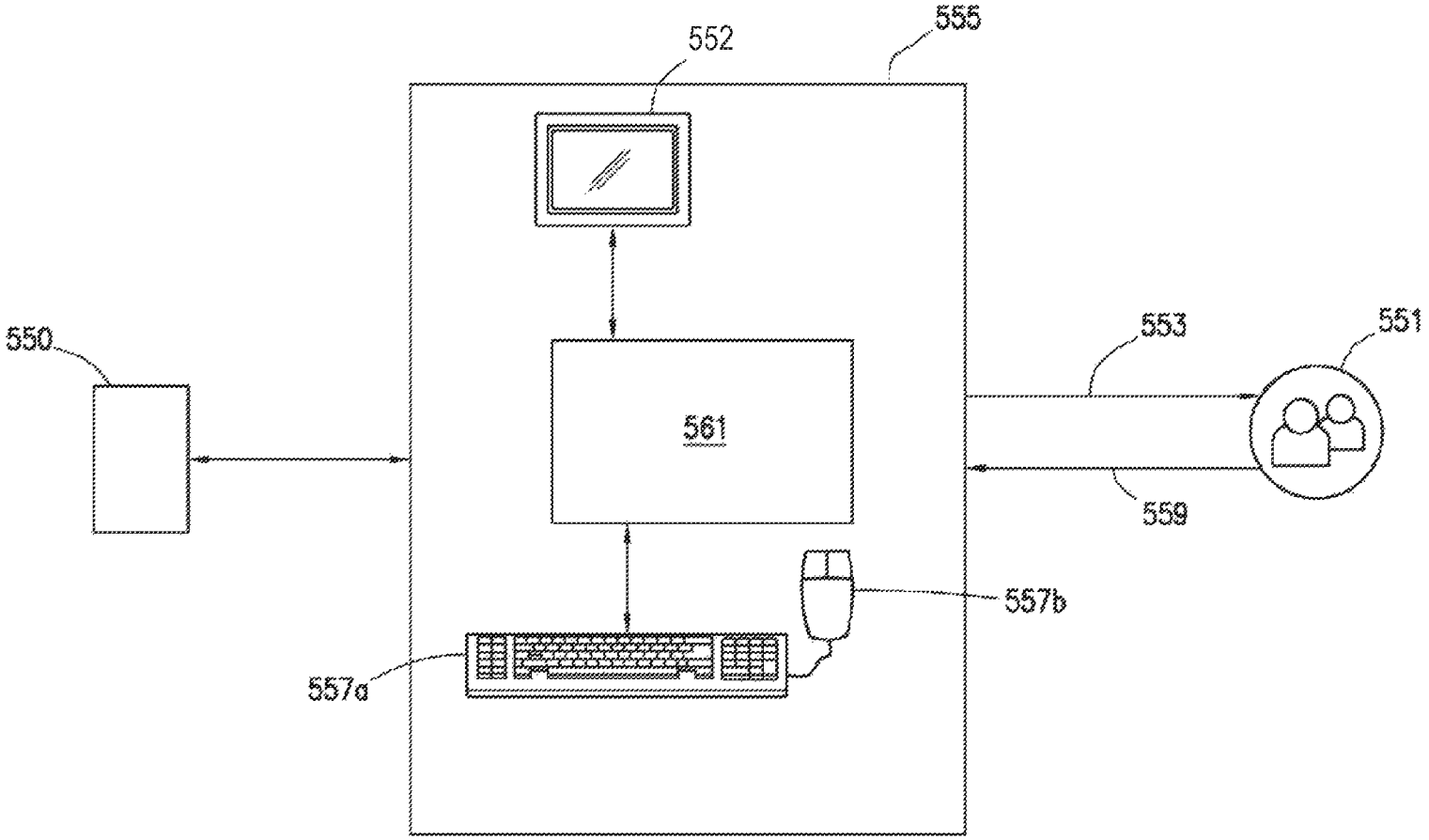
FIG. 5B is a schematic view of a portion of the BOP monitoring system of FIG. 5A.

As shown in FIG. 5B, the users 551 may interface with the outputs 558*a-c* and BOP subdatabases 556*a-e* via an interface 555. The interface 555 may be in the form of, for example, a computer with a screen or monitor 552, a keyboard 557 *a*, a mouse 557 *b*, and a processor 561. The user 551 receives information from the data from the BOP unit 550 as indicated by arrow 553. The user 551 may also input information to the BOP unit 550 as indicated by arrow 559. This user information may include user data that may be incorporated into one of more of the subdatabases 556*a-e*.

Referring to FIGS. 5A and 5B, data (e.g., from the wellsite 500) may be sent to one or more locations, such as an onshore data base, for data aggregation. Data may be logged and sent into an equipment management system, such as the RIGMS™. Real-time force displacement calculations may be done to assist in monitoring the health of components that make up the BOP system. This data may be gathered to determine, for example, ram/annular cycle duration, ram/annular rubber goods health, ram/annular piston health, force exerted on valves during duration of each cycle, cycle counts, etc.

The outputs 558*a-c* may be analyzed by one or more of the users 551. The users 551 may be individual engineers or engineering teams that receive, analyze and adjust the information. For example, the users may select portions of the data as being either highly pertinent for further review or erroneous to be deleted. The users 551 may also input additional data or refined versions of the data to be fed back into the BOP unit 550. In this manner, the BOP unit 550 may continue to update as new information and analysis is received. This feedback may incorporate knowledge and/or data from multiple locations, based on a variety of perspectives and information.

The users 551 and/or other portions of the BOP unit 550 may also be in the form or use processors, controllers, memories, computers and/or other features capable of receiving, processing, manipulating, outputting or otherwise using data for certain purposes or for determining specific BOP characteristics. The outputs 558*a-c* may work alone or in combination. For example, force displacement may be calculated by the BOP monitoring system. Software, such as eHawk™ commercially available from NATIONAL OILWELL VARCO™ (see: www.nov.com), may be used to generate at least some of the desired calculations. Curve characteristics, such as a degradation model, may be monitored over time to detect patterns that may indicate changes in operation of the BOP. Additional processors and/or other devices may be provided about the BOP unit 550.

Figure 6A:
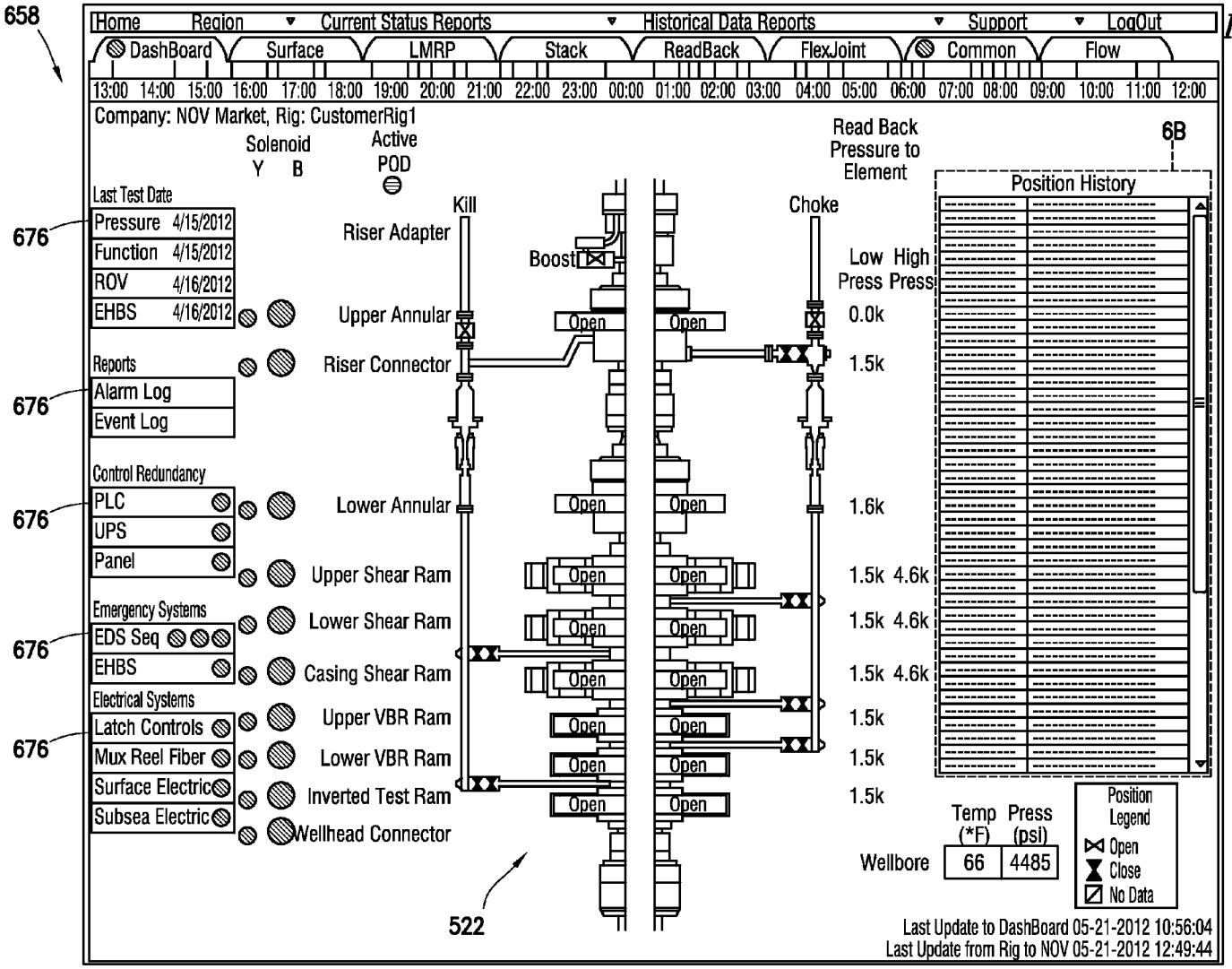

FIGS. 6A and 6B show an example dashboard 658*a* generated from the BOP monitoring system 501 of FIG. 5. FIG. 6A depicts the dashboard 658*a* and FIG. 6B depicts a portion of the data displayed relating to position history of rams of the BOP. The dashboard 658*a* provides a graphical depiction of BOP 522 with various indicators 676 thereon. The indicators 676 may display various values, such as pressure, temperature, force displacement, rubber displacement, and/or other BOP parameters generated, for example, sensors 540*a,b* and/or other data collected by the databases 554, 556*a-c*. Other items are also displayed, such as position history, and various components of the BOP 522. The various indicators may be selectively lighted or colored to alert, for example, an out of range condition. Predetermined parameters may be set forth criteria for alerts. This view provides a consolidated view of the overall operating condition of the BOP 522. Optionally, the dashboard may be tailored to the needs of the user.

If desired, various portions of the display 658 may be interactive, thereby providing one or more users with interaction with the BOP data, analysis and other features of the BOP dashboard 658*a*. The BOP dashboard gives a consolidated view of the BOP 522 and its control system. Indicators 676 (or health lamps) may be grouped along the image of the BOP 522 by logical zones to display the BOP 522 at a glance. A history of alarms for the last 24 hours is provided. Clicking on an individual zone under alert brings the user a report of all alarms present during that time period. Also, if an alarm is active in one of the zones, the lamp changes from a green circle to a yellow triangle to raise an alert. The user can hover over that triangle to see exactly which fault is present.

The system 501 may be used, for example, to constantly monitor commands, pressures, and flow meters. When an event occurs, the system may review the last interval (e.g., about 5 minutes) of pressure data for that circuit to ensure that no other event is in process or has just occurred. Once satisfied, the system may run an average on the last sixty seconds of data just before the event, and captures an averaged number therefrom. The averaged number may be used later in the calculation to assist in determining the end of the cycle. After the event occurs, pressure in the circuit may immediately drop, and this drop may have a direct relationship to the diameter and length of the conduit. Once mechanical restriction begins on the end component, pressure in the circuit may being to rise again. At the same time, the flow totalizer in the circuit may begin counting up gallons from the moment the cycle begins. The instant directly after the last pressure spike, while counting by a totalizer may be compared to the averaged sample noted above. When the two numbers agree, the cycle is complete.

Figure 7A:
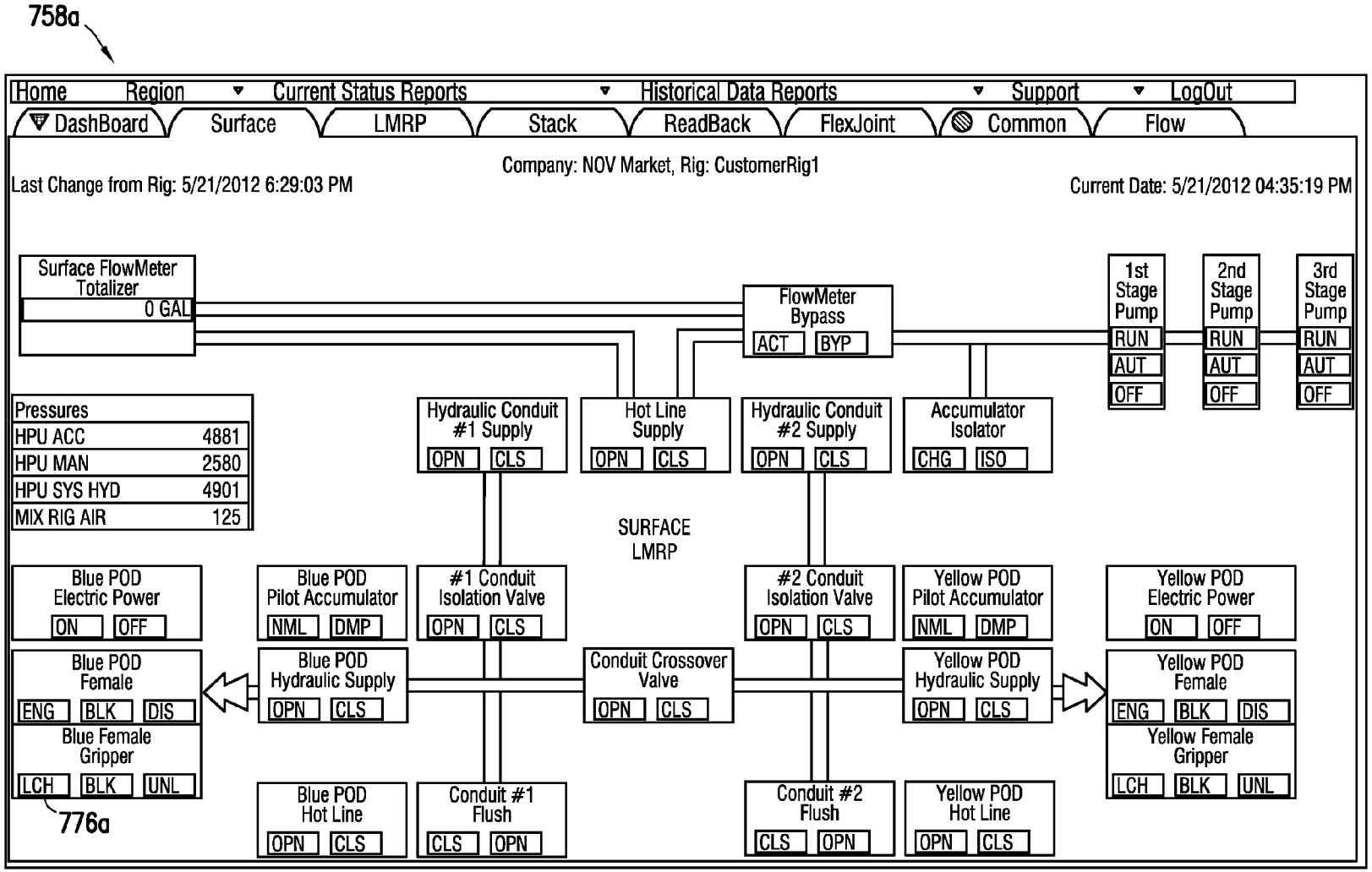
Figure 7B:
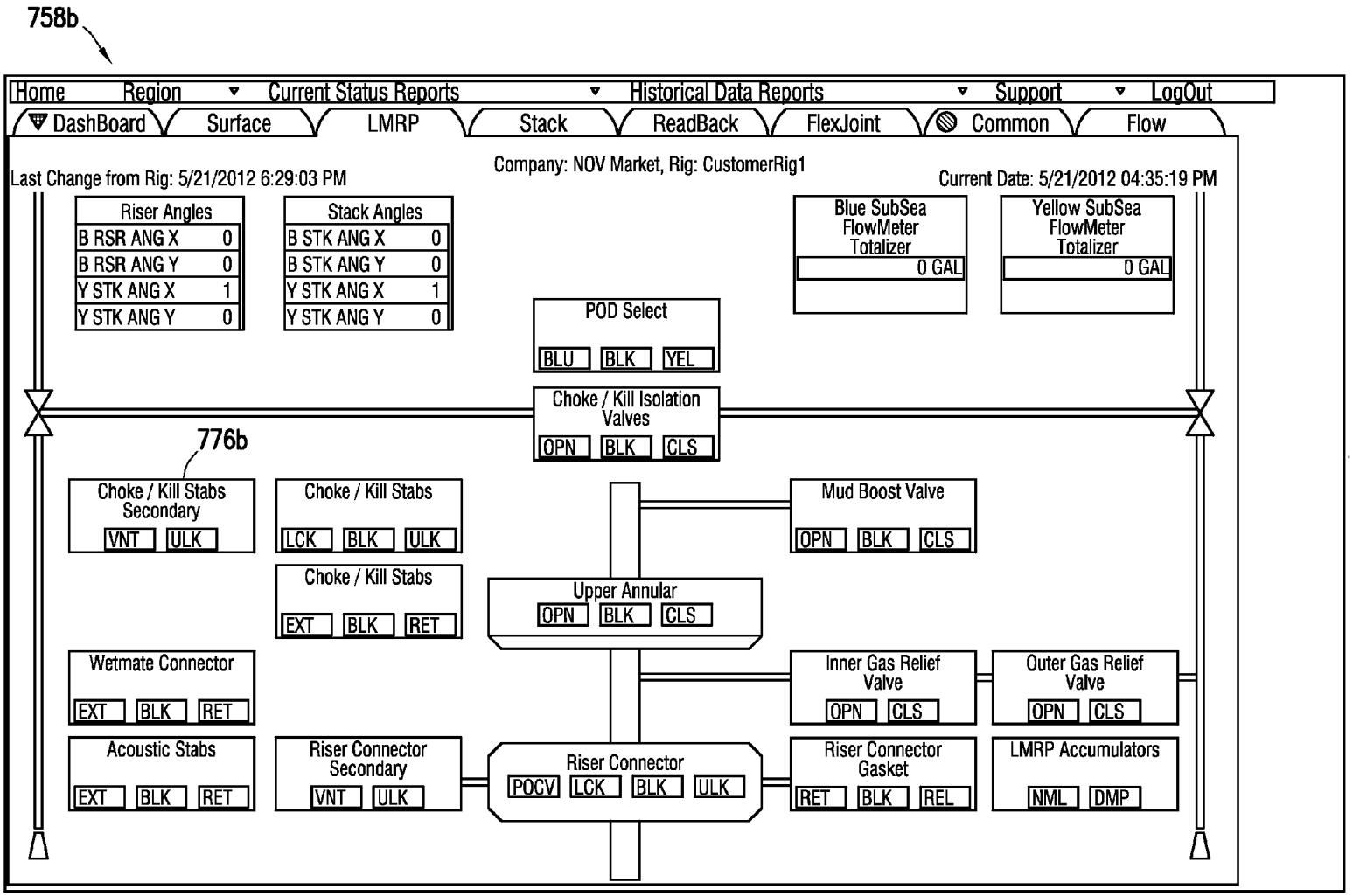
Figure 7C:
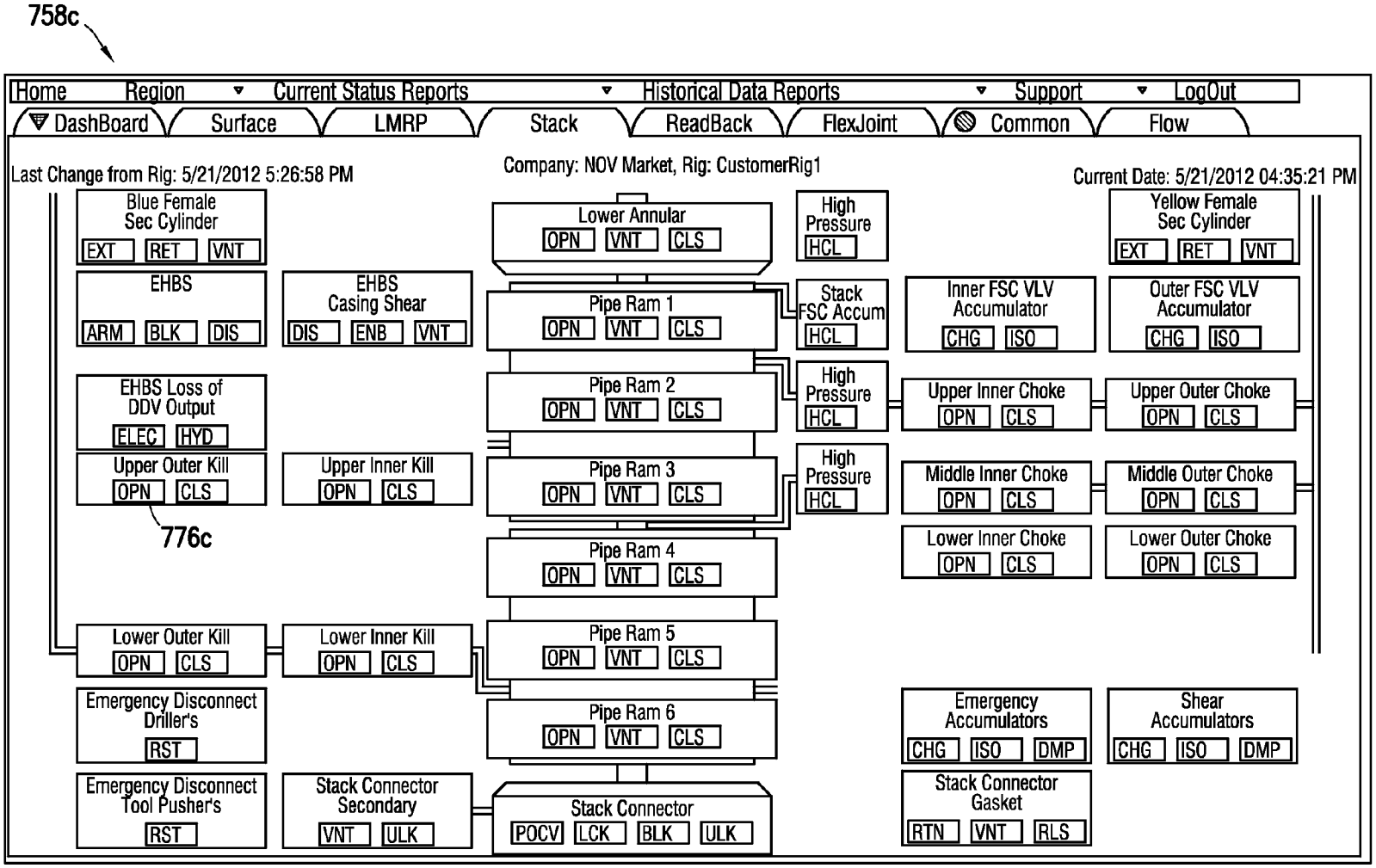
Figure 7D:
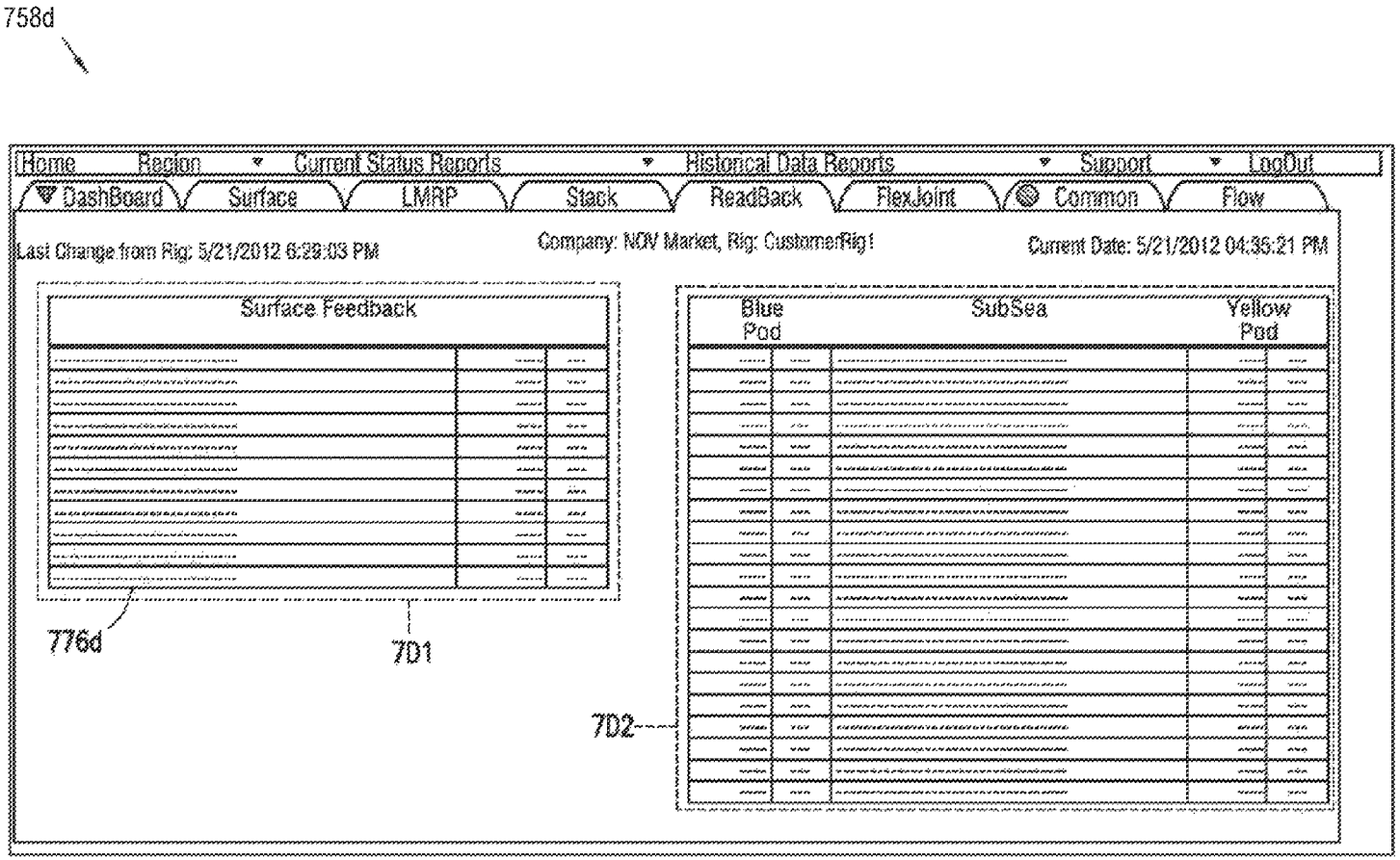
Figure 7E:
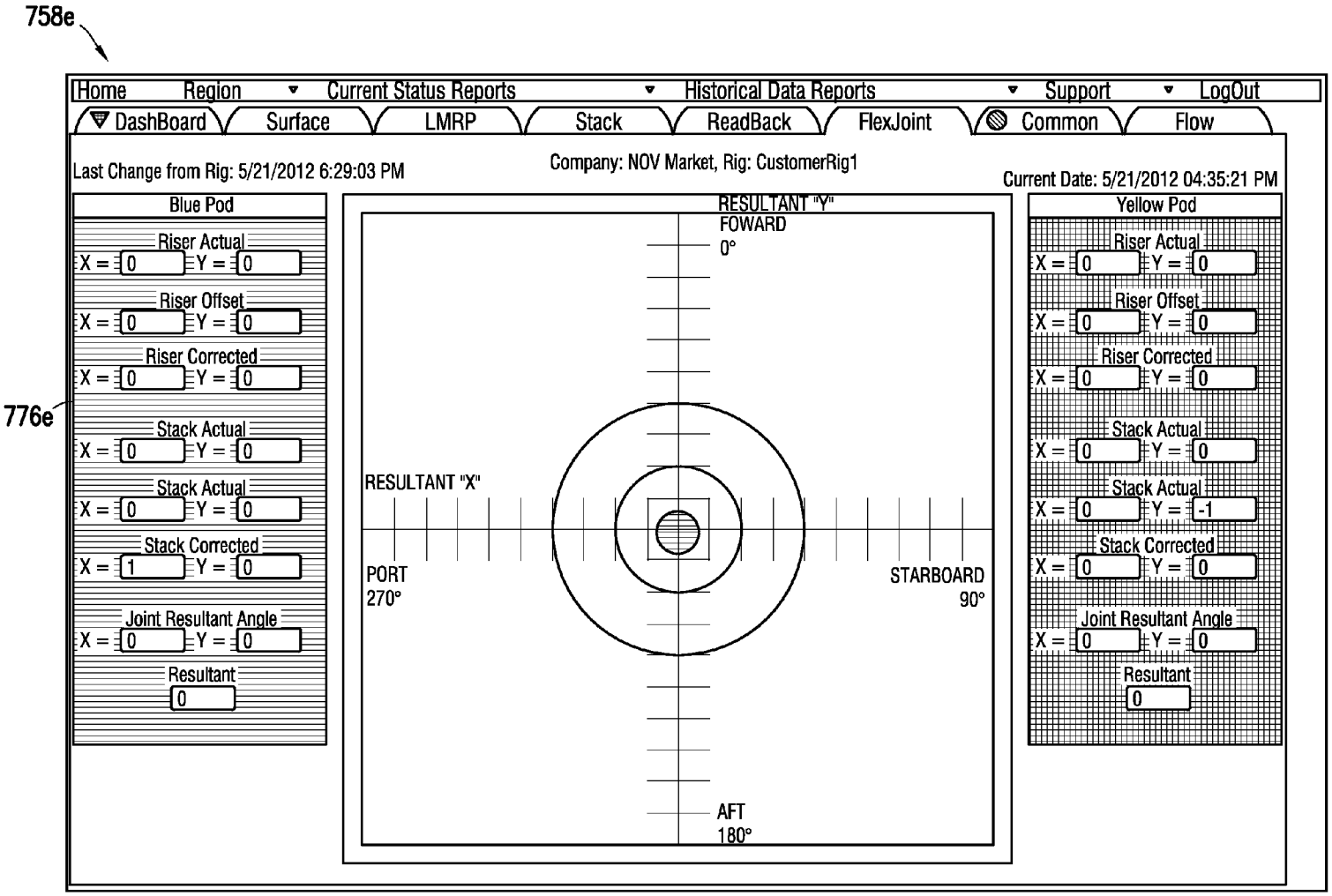
Figure 7F:
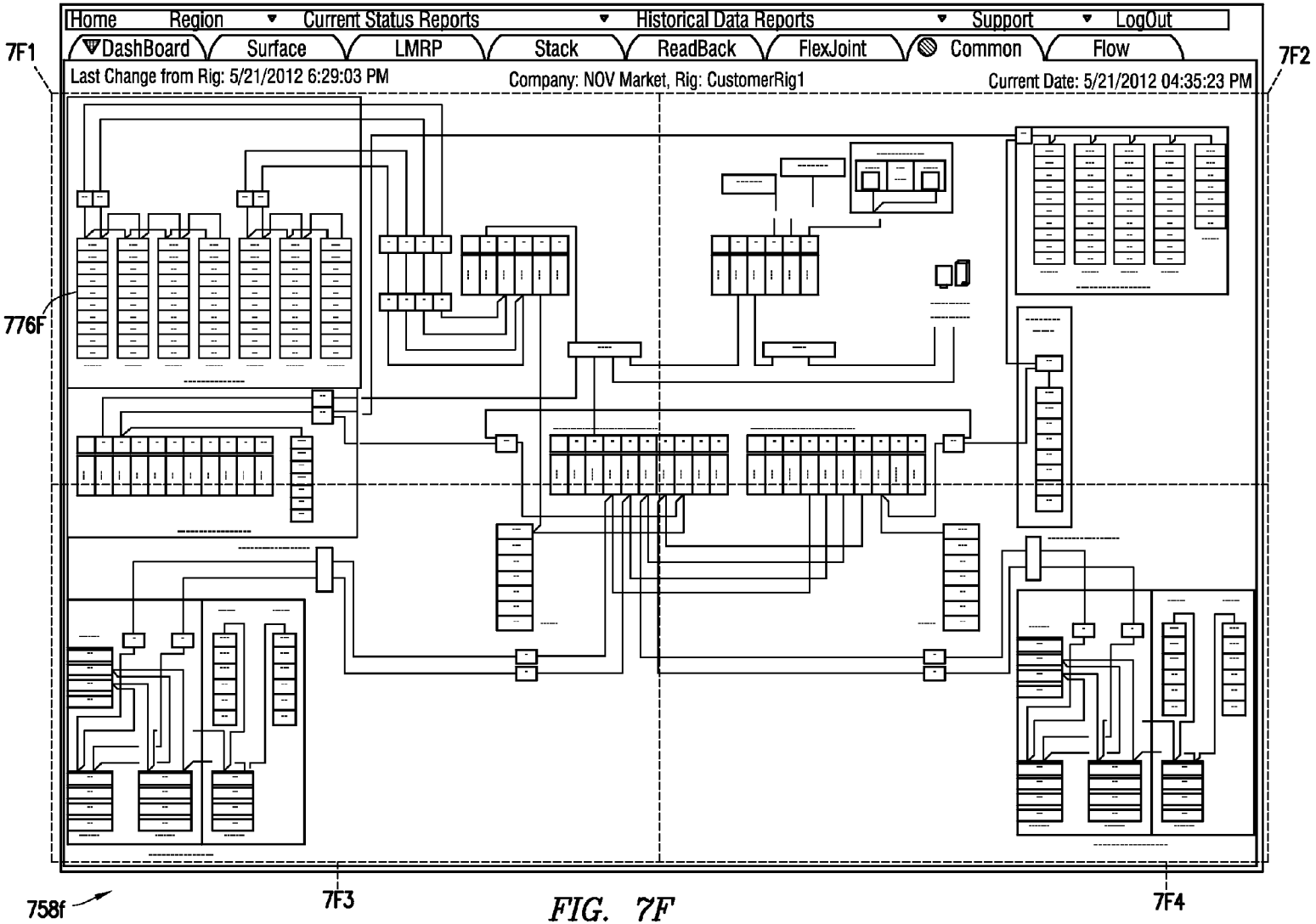
Figure 7H:
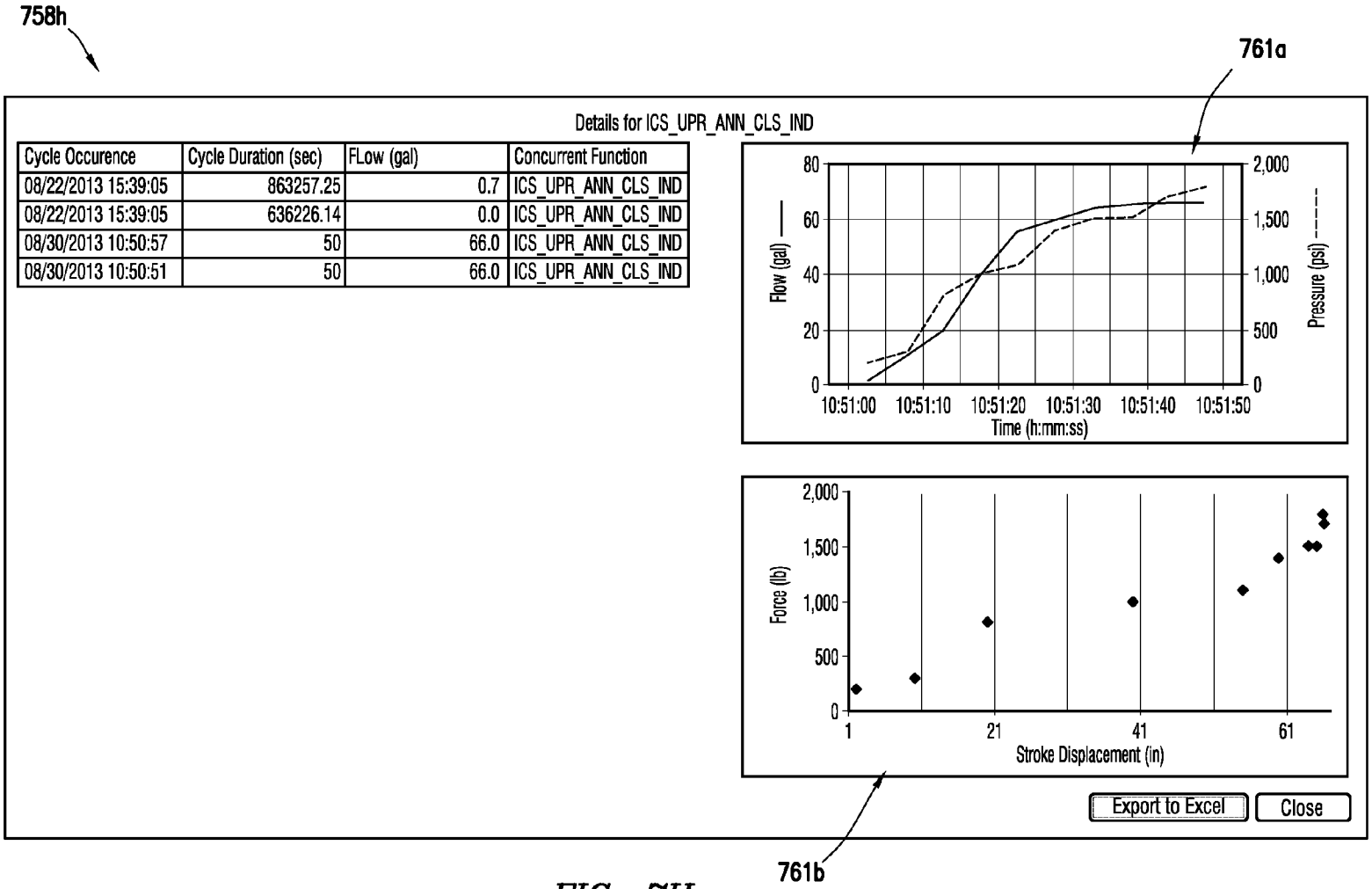

The BOP dashboard 658*a* also permits a user to select one or more additional screens for viewing. The user may select various displays detailing features of the various portions of the BOP 522. For example, as shown in FIGS. 7A-7H, one or more displays 758*a-h* may be provided with further details. For example, FIG. 7A depicts surface equipment 758*a*, FIG. 7B depicts low marine riser package (LMRP) 758*b*, FIG. 7C depicts stack 758*c*, FIGS. 7D, 7D1, and 7D2 depict readback 758*d*, FIG. 7E depicts flexjoint 758*e*, FIGS. 7F and 7F1-F4 depict common 758*f*, FIGS. 7G1 and 7G2 depict force displacement 758*g*, and FIG. 7H depicts flow 758*h*. Indicators 776*a-h* are provided on each of the displays 758*a-h*. Additional displays with various indicators may be provided as desired.

Surface equipment 758*a* provides a reference for functions associated with the surface equipment. LMRP 758*b* provides a reference for functions associated with the LMRP. Stack 758*c* provides a reference for functions associated with the stack. Readback 758*d* provides a consolidated list of critical pressures to be monitored. This screen may be used in conjunction with a schematic, for example, to troubleshoot hydraulic circuits. Flexjoint 758*e* provides a reference of stack/riser position in relation to the rig. Common 758*f* provides topology with an indication of the specific module or zone in fault by changing it to red. This may be used to troubleshoot by allowing the user to identify specific zones in the system that may be experiencing a problem. Force displacement 758*f* provides a reference for force displacement functions associated with the operation of the ram blocks. Flow 758*h* displays cyclic information concerning ram operation. As shown in flow 758, graphs 761*a,b* may be provided to display operational parameters, such as pressure (761*a*) and stroke displacement (761*b*) of BOP rams (e.g., rams 232 of FIG. 2).

In an example using force displacement as shown in FIGS. 3, 7G1-G2 and 7H, BOP data concerning operation of the ram blocks 232 is collected form sensors 240*a, b* (FIGS. 2 and 5) and passed to the BOP unit 550 (FIG. 5). The BOP data is passed to the various databases 554, 556*a-e*. The BOP control units 557*a-f* determine wellsite parameters by combining the data relating to the various wellsite parameters, such as those depicted in FIGS. 3, 7A-7H. Users may receive 553 outputs 558*a-c* and provide input 559 as shown in FIG. 5B. The outputs 558*a-c* may selectively display portions of the wellsite data that relate to specific indicators and/or parts of the BOP as shown in FIGS. 6A and 6B. Equipment output 558*b* may send information to the user concerning maintenance schedules, report and/or alerts identifying repair needs for the rams. The report manager 558*c* may be used to send reports concerning the ram blocks and their operation over time.

As shown in FIGS. 3, 7G1-G2 and 7H, force displacement of the ram blocks may be monitored over time. The BOP unit 550 may perform automated force displacement calculations in real time. Each time an annular is closed the calculation may be run using one or more of the BOP control units 557*a-g*, and a plot generated on the dashboard 558*a*. For example, a SHAFFER™ 18-10M spherical BOP (commercially available at www.nov.com) has a piston closing area of 1781 square inches (4523.74 sq cm). The volume of fluid entering the closing chamber may be measured, and the stroke of the piston determined in inches (cm). The force calculation may be determined by multiplying piston area by closing pressure.

When a new packing element is closed for the first time, maximum force may be achieved very early in the cycle. As the sacrificial area on the inside diameter of the packing element is removed due to wear, the characteristic of that plot begins to change. The maximum force may be achieved later and later in the following cycles. If the packing element is used beyond the recommended duty life, the plot may eventually show no force achieved on the last cycle. This may indicate that no effective seal on a complete shut off, or on pipe.

As shown in FIG. 7H, cyclic operation of the BOP rams may be automatically captured and remotely displayed for each of the valves in the BOP subsea package. As shown, the display may depict each data set with the date/time the cycle occurred, the pressure present on the valve during the cycle, and the gallons of fluid moved through the valve during the cycle. This information may be sent in to the equipment output 558*b* as an automatic meter read. The report manager 558*c* may use RIGMS™ to generate a maintenance report based on those cycles. The user may configure criteria for maintenance.

Referring back to FIG. 5, the equipment output 558*b* includes an asset management system (e.g., RIGMS™) for maintenance and tracking. Maintenance and tracking may be used by tying into asset maintenance tracking systems. Users (e.g., customers, original equipment manufacturers etc.) may run hours and cycles with specific parts and/or build baseline for part lifecycle. The asset management system may provide fit for purpose tags/equipment/software for the drilling contractor business. Access to information may be used to provide asset location and status for real time web-based applications, document management for asset documentation (e.g., manuals, maintenance procedures, etc.), tracking for tracking material transfers and locating assets being moved including transfers to vendors, quality for setting appropriate maintenance schedule and procedures for each asset according to equipment requirements, compliance for alerting field personnel when planned maintenance is due ensuring maintenance is done on time, unplanned events for recording and capturing unplanned repair and maintenance events in reports, productivity for managing productivity by daily maintenance planning (e.g., using RIGMS™ work order planner, cost control for tracking parts cost and usage by individual asset, make, or class, and/or analysis for tracking workorder trends and supporting continuous improvement goals.

The equipment output 558*b* may be used to determine whether an equipment failure has occurred from the data collected from the databases 554 and 556*a-d*. For example, force displacement curves, such as those in FIG. 3, may be generated and compared to determine if a change in the force and/or time required to activate the BOP rams has occurred. In another example, the amount of rubber that has exited the BOP ram may be measured, monitored and tracked over time to determine if the BOP seals have worn. If such potential failure is determined, alerts, workorders, maintenance requests and/or other actions may be generated by the equipment output 558*b*. Records may also be maintained as needed.

The equipment output 558*b* may analyze operations using an asset management system, such as RIGMS™ commercially available from NATIONAL OILWELL VARCO™ (see: www.nov.com). This system may be used to house all of the information related to a rig's assets. The information may be provided in real time for access during operations. The system may be used to gives customers the ability to access this information in near real-time from the internet. This may also be used to display how cycles are tracked for each valve. Measurements may be collected and analyzed in real time. The measurements may be transmitted via the communication system to various locations, such as an onshore server. Reports may be sent automatically as desired.

For example, a customer may have a system with 224 valves. This customer may change out 25% of the valves each quarter. The customer may set a goal to eventually transition from 25% per quarter, to 25% per year. This may be done by building a valve use history using this system. When the rig plans to pull the stack, they flag RIGMS™ with that date. On that day, RIGMS™ generates a planned work order. That work order lists the 25% of the valves that were used the most. The technician can now change out those valves first. The technician may then enter a new serial number in to the system. This may be used to generate a cost savings by timing the changes according to the maintenance history. For example: if for 80% of the time the rig repairs a valve with a kit at $320, and 20% of the time with a new valve at $5000, the cost would be roughly $285,622 a year per rig on those valves and kits. To facilitate transition to the requested 25% change out per year, a savings of about $210,000 in parts may be provided.

As also shown in FIG. 5, the report manager 558*c* may include, for example, COC (Certificate of Compliance) test, function test, pressure test, equipment utilization, field data reports, removement, end of well, daily states. The report generator 558*c* may provide additional displays for sending reports and alerts. Communications may be selected and/or sent as desired. On or offsite reports may be customized and/or generated. For example, an onshore engineer could run a report on wellbore pressure for the last 24 hours. Proactive reports may also be generated as a result of information gathered. These are configured by, and sent to the report manager.

The various outputs, such as alarms, reports and displays, may interact to generate desired outputs as needed. Emails may be sent as desired (e.g., regular or special emails) to selected recipients for information and/or as an alert to BOP conditions. For example, data may be displayed on a dashboard, alerts sent for out of range conditions, and reports sent concerning equipment and other conditions. The equipment management system may generate maintenance reports. The outputs may also interact to monitor the health of the BOP (e.g., rubber goods on rams and annulars) over time. Automatic alerts may be generated indicating that parts are near the end of life or failure. This may be done by using pressure, fluid temperature, and flow totalizers. Advanced analytics, such as artificial intelligence software used to watch for specific patterns and generate reports, may also be performed.

Multiple sources may receive and process the data and/or reports. Once communicated, the reports and other information may be used to optimize wellsite operations, such as drilling, production, and other operations. One or more locations may collaborate directly or indirectly to collect and/or analyze data, thereby providing synergistic interaction between multiple sources, such as users 551, for generating an overall optimized operation. Such interaction may allow users to see actions of other users, or be done indirectly using the BOP unit 550. Input from the sources may be fed into one or more of the databases to update the information. The process may be repeated as new information becomes available. The communications may be done in real time to provide for decisionmaking as operations are performed. Feedback may be sent to the wellsite in real time to enable automatic and/or manual control of wellsite operations.

Communications may be performed via the internet to permit multiple sources at one or more locations to collaborate on wellsite operations as they occur. Analyzed data may be provided to the sources, and the sources may adjust the information based on knowledge of the source(s). Information and access may be made available at all times via the internet. Data may be presented in a logical way to permit operations teams at the sources to make informed decisions. The constant feedback of new information from the wellsite and the users may be used to provide updates and send commands to the wellsite for changes as needed. Action may be taken at the wellsite to adjust operations, for example by performing maintenance and/or adjusting operational settings and/or equipment.

The BOP monitoring system may provide for management and visibility of multiple sites from on and offsite locations. The BOP monitoring system may provide a centralized management center may be provided to allow technicians to assist BOP operations remotely and in real time. This may be used to provide the ability to remotely see wellsite operations and breaking down communication barriers.

Figure 8A:
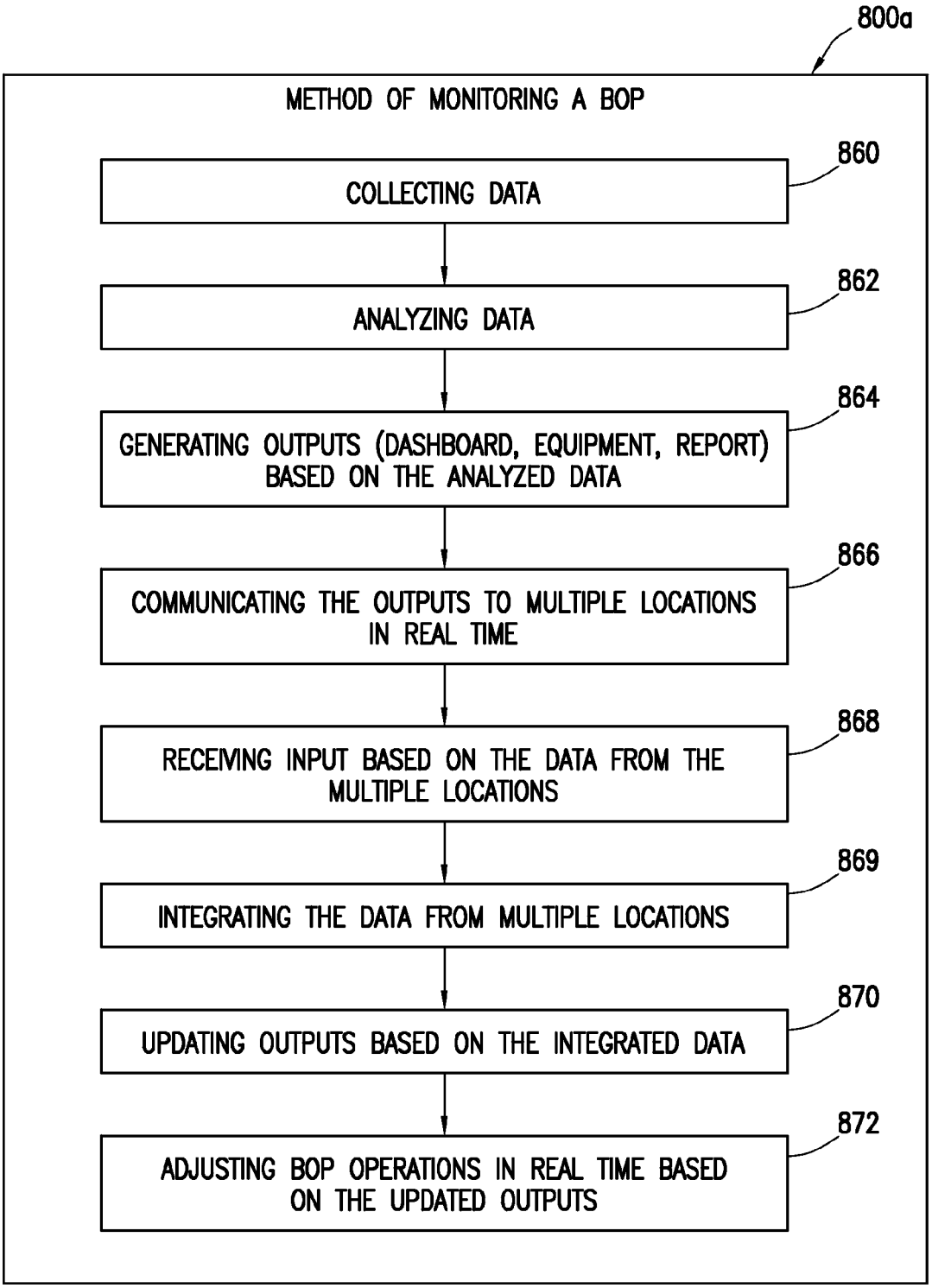
FIGS. 8A-8C are flow charts depicting methods of monitoring a BOP.

FIG. 8A depicts a method 800*a* of monitoring a BOP, such as the BOPs provided herein. The method involves 860 collecting data from the BOP (e.g., in databases), 862 analyzing the data, 864 generating outputs (e.g., dashboard, equipment reports, etc.) based on the analyzed data, 866 communicating the outputs to multiple locations in real time (e.g., via satellite), 868 receiving input based on the data from the multiple locations (e.g., feedback from high level users), 869 integrating data from multiple locations, 870 updating outputs based on the integrated data, and 872 adjusting BOP operations in real time based on the updated outputs (e.g., performing maintenance and/or using surface and/or downhole units to adjust operations).

Figure 8B:
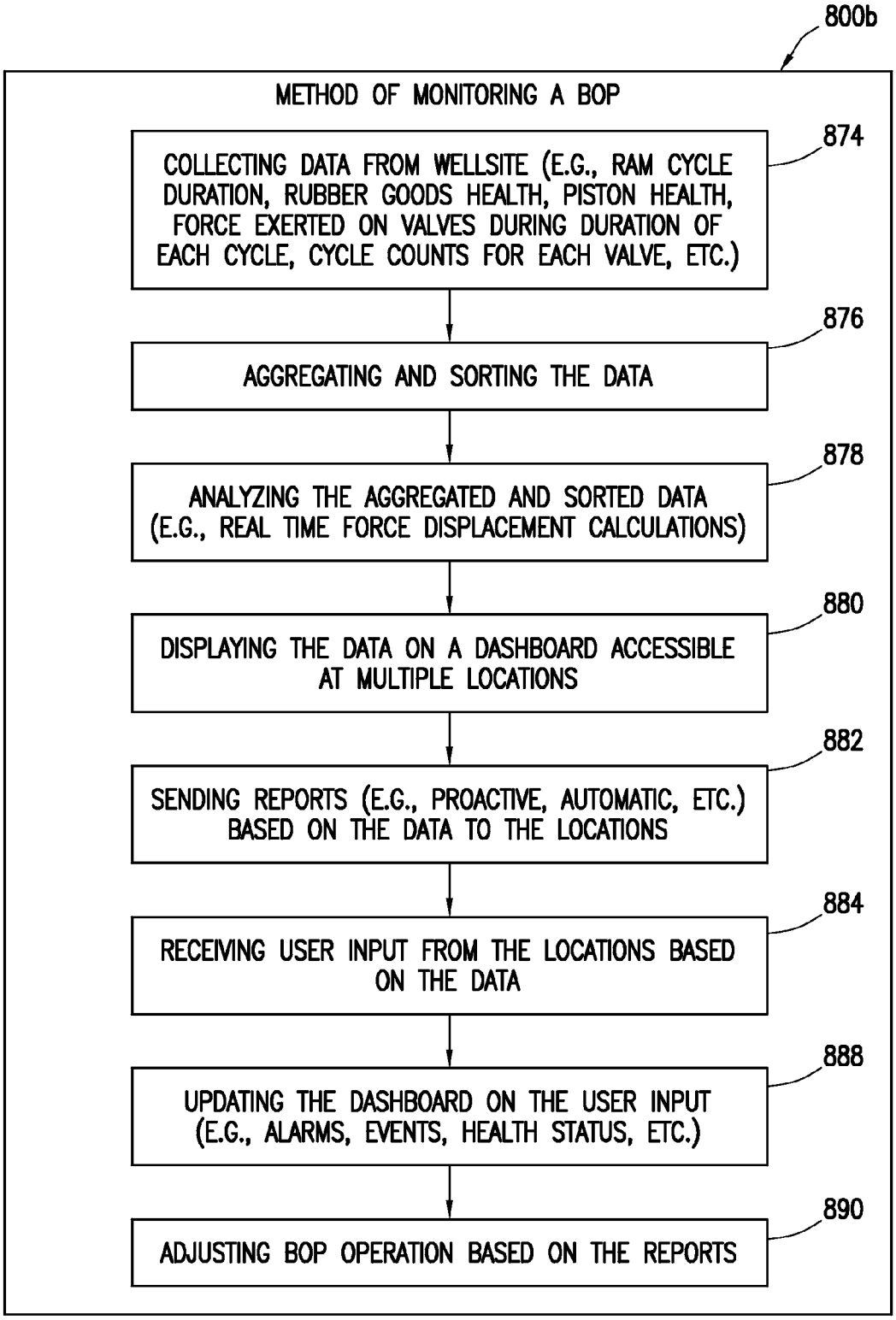

FIG. 8B depicts another method 800*b* of monitoring a BOP. In this version, the method involves 874 collecting data from wellsite (e.g., ram cycle duration, rubber goods health, piston health, force exerted on valves during duration of each cycle, cycle counts for each valve, etc.), 876 aggregating and sorting the data, 878 analyzing the data (e.g. real time force displacement calculations), 880 displaying the data on a dashboard accessible at multiple locations, 882 sending reports (e.g. proactive, automatic, etc.) based on the data to the locations, 884 receiving user input from the locations based on the data, 888 updating the dashboard based on the user input and providing processed reports (e.g., alarms, events, health status, etc.), and 890 adjusting BOP operation(s) based on the reports.

Figure 8C:
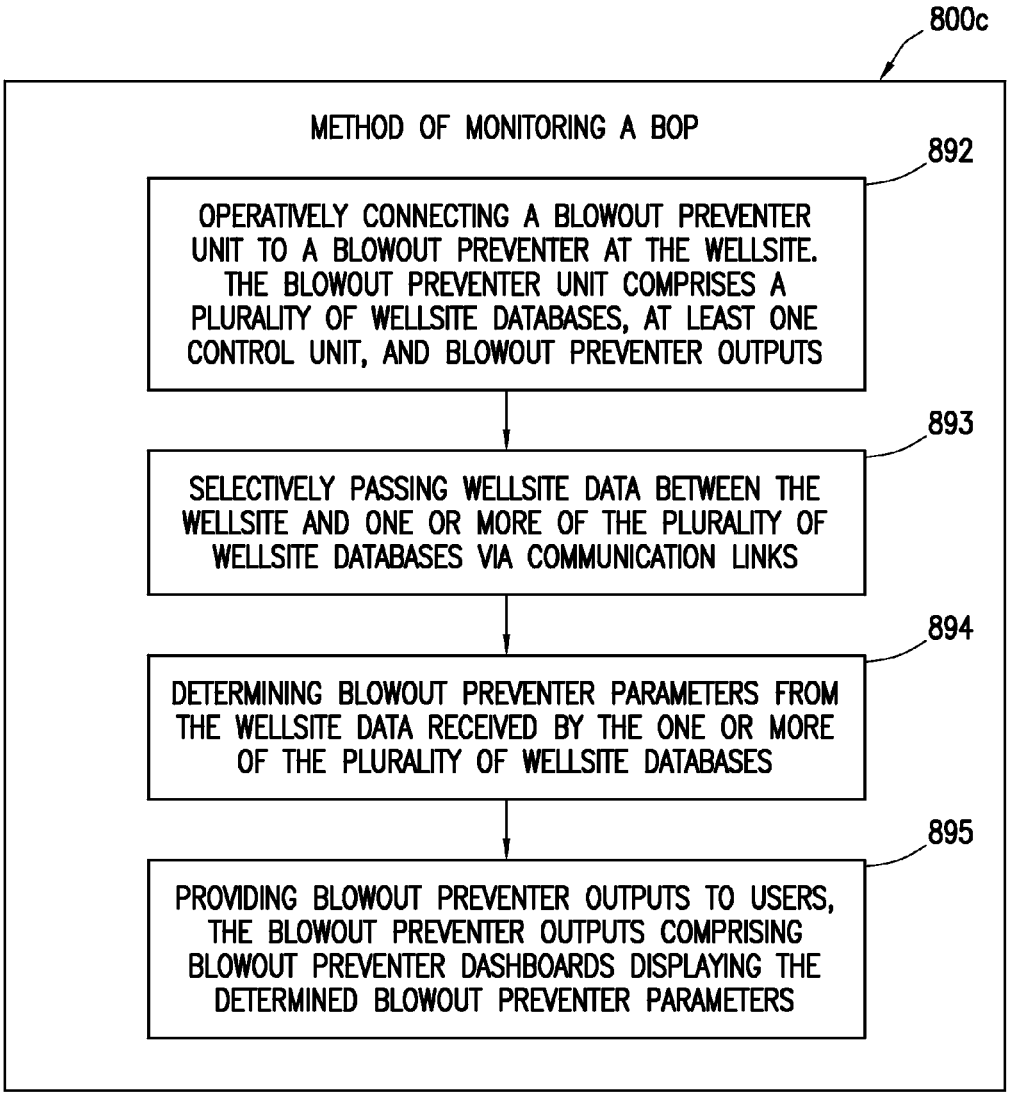

FIG. 8C depicts another method 800*c* of monitoring a blowout at a wellsite. The method 800*b* involves 892 operatively connecting a blowout preventer unit to a blowout preventer at the wellsite. The blowout preventer unit includes a plurality of wellsite databases, at least one control unit, and blowout preventer outputs. The method 800*c* also involves 893—selectively passing wellsite data between the wellsite and one or more of the plurality of wellsite databases via communication links, 894—determining blowout preventer parameters from the wellsite data received by the one or more of the plurality of wellsite databases, and 895 providing blowout preventer outputs to users, the blowout preventer outputs comprising blowout preventer dashboards displaying the determined blowout preventer parameters.

The methods may be performed in any order, or repeated as desired. Various combinations of the methods may also be provided.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more databases may be provided to generate one or more outputs to one or more users for selective manipulation of data and/or control of BOP operations at the wellsite.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A blowout preventer unit for monitoring a blowout preventer at a wellsite, the blowout preventer activatable to form a seal to prevent leakage of the fluid produced from subsurface formations, the blowout preventer unit comprising:

a BOP database operatively connectable to the wellsite and configured to receive wellsite data therefrom via communication links therebetween;

a plurality of wellsite subdatabases operatively connectable to the BOP database;

at least one control unit operatively connectable between the BOP database and the plurality of wellsite subdatabases and configured to selectively divert the wellsite data received from the wellsite via the communication links from the BOP database to one or more of the plurality of wellsite subdatabases, wherein the at least one control unit comprises at least one processor configured to determine blowout preventer parameters from the wellsite data and selectively divert the blowout preventer parameters to at least one of the plurality of wellsite subdatabases; and a plurality of blowout preventer outputs, wherein each of the plurality of blowout preventer outputs is operatively coupled to at least one of the plurality of wellsite subdatabases, wherein at least one of the plurality of blowout preventer outputs is configured to generate a blowout preventer dashboard configured to display a graphical representation of the blowout preventer with a plurality of indicators for selectively displaying at least a portion of the wellsite data, the determined blowout preventer parameters, and blowout preventer conditions from the wellsite subdatabases thereon, and wherein the blowout preventer dashboard is configured to allow selection of a plurality of other dashboards configured to display different portions of the wellsite data, the determined blowout preventer parameters, and the blowout preventer conditions associated with different portions of the blowout preventer not displayed by the blowout preventer dashboard;

wherein the blowout preventer unit is configured to adjust operation of the blowout preventer in response to the wellsite data, the determined blowout preventer parameters, and the blowout preventer conditions.

2. The blowout preventer unit of claim 1, wherein the wellsite data comprises ram block data, and the blowout preventer parameters comprise ram block parameters, wherein the blowout preventer dashboard displays the ram block parameters.

3. The blowout preventer unit of claim 2, wherein the ram block parameters comprise at least one of force displacement, ram cycle, pressure, temperature, position, fluid flow, equipment, rubber displacement, and historical data.

4. The blowout preventer unit of claim 1, wherein the plurality of subdatabases comprises a dashboard database, a force displacement database, a cycle database, an equipment database, and a report database.

5. The blowout preventer unit of claim 4, wherein the blowout preventer dashboards and each of the other dashboards are operatively connected in communication to at least one of the dashboard database, the force displacement database, the cycle database, the equipment database, and the report database.

6. The blowout preventer unit of claim 4, wherein the blowout preventer outputs further comprise an equipment output, wherein the equipment output is operatively connected in communication to the dashboard database, the force displacement database, the cycle database, and the equipment database.

7. The blowout preventer unit of claim 4, wherein the blowout preventer outputs further comprise a report manager, wherein the report manager is operatively connected in communication to the report database.

8. The blowout preventer unit of claim 1, wherein the users provide input to the plurality of wellsite subdatabases.

9. The blowout preventer unit of claim 1, wherein the blowout preventer dashboard comprises a high level health and communication tool.

10. The blowout preventer unit of claim 9, wherein the blowout preventer outputs further comprises at least one of an equipment output and a report output.

11. The blowout preventer unit of claim 9, wherein the plurality of indicators comprise a pressure, a temperature, a force displacement, and a rubber displacement associated with the blowout preventer.

12. The blowout preventer unit of claim 9, wherein the other dashboards comprise displays of at least one of surface equipment, low marine riser package, stack, readback, flex-joint, common, force displacement, and flow.

13. A monitoring system for a wellsite, the wellsite producing fluid from subsurface formations, the monitoring system comprising:

a blowout preventer activatable to form a seal to prevent leakage of the fluid; and a blowout preventer unit operatively connectable to the blowout preventer, comprising:

a BOP database operatively connectable to the wellsite and configured to receive wellsite data therefrom via communication links therebetween;

a plurality of wellsite subdatabases operatively connectable to the BOP database;

at least one control unit operatively connectable between the BOP database and the plurality of wellsite subdatabases and configured to selectively divert the wellsite data received from the wellsite via the communication links from the BOP database to one or more of the plurality of wellsite subdatabases, wherein the at least one control unit comprises at least one processor configured to determine blowout preventer parameters from the wellsite data and selectively divert the blowout preventer parameters to at least one of the plurality of wellsite subdatabases; and a plurality of blowout preventer outputs, wherein each of the plurality of blowout preventer outputs is operatively coupled to at least one of the plurality of wellsite subdatabases, wherein at least one of the plurality of blowout preventer outputs is configured to generate a blowout preventer dashboard configured to display a graphical representation of the blowout preventer with a plurality of indicators for selectively displaying at least a portion of the wellsite data, the determined blowout preventer parameters, and blowout preventer conditions from the wellsite subdatabases thereon, and wherein the blowout preventer dashboard is configured to allow selection of a plurality of other dashboards configured to display a different portion of the wellsite data, the determined blowout preventer parameters, and the blowout preventer conditions associated with different portions of the blowout preventer not displayed by the blowout preventer dashboard;

wherein the blowout preventer unit is configured to adjust operation of the blowout preventer in response to the wellsite data, the determined blowout preventer parameters, and the blowout preventer conditions.

14. The monitoring system of claim 13, further comprising an interface operatively connecting the users to the blowout preventer unit.

15. The monitoring system of claim 14, wherein the interface comprises a computer to display the blowout preventer dashboard and the other dashboards to the user and to receive input from the user.

16. The monitoring system of claim 13, further comprising a communication link between the blowout preventer unit and the blowout preventer.

17. The monitoring system of claim 13, further comprising a surface unit at the wellsite.

18. The monitoring system of claim 17, further comprising wellsite sensors operatively connected to the blowout preventer and configured to collect wellsite data therefrom and communicate the wellsite data to the surface unit.

19. The monitoring system of claim 18, wherein the surface unit is operatively connected to the BOP database via the communication links and configured to communicate the wellsite data to the BOP database therefrom.

20. A method of monitoring a blowout preventer at a wellsite, the blowout preventer activatable to form a seal to prevent leakage of the fluid produced from subsurface formations, the method comprising:

operatively connecting a blowout preventer unit to a blowout preventer at the wellsite, the blowout preventer unit comprising a BOP database and a plurality of wellsite subdatabases, at least one control unit, and a plurality of blowout preventer outputs;

receiving wellsite data from the wellsite into the BOP database;

selectively diverting the wellsite data received from the wellsite from the BOP database to one or more of the plurality of wellsite subdatabases via communication links;

determining blowout preventer parameters from the wellsite data received by the one or more of the plurality of wellsite subdatabases;

selectively diverting the determined blowout preventer parameters to one or more of the plurality of wellsite subdatabases via the communication links;

operatively connecting the plurality of blowout preventer outputs to one or more of the plurality of wellsite subdatabases, wherein at least one of the plurality of blowout preventer outputs is configured to generate a blowout preventer dashboard configured to display a graphical representation of the blowout preventer with a plurality of indicators for selectively displaying at least a portion of the wellsite data, the determined blowout preventer parameters, and blowout preventer conditions from the wellsite subdatabases thereon, and wherein the blowout preventer dashboard is configured to allow selection of a plurality of other dashboards configured to display different portions of the wellsite data, the determined blowout preventer parameters, and the blowout preventer conditions associated with different portions of the blowout preventer not displayed by the blowout preventer dashboard; and adjusting operation of the blowout preventer in response to the wellsite data, the determined blowout preventer parameters, and the blowout preventer conditions.

21. The method of claim 20, wherein the blowout preventer parameters are ram block parameters and wherein the providing comprises displaying ram block parameters to the user over time such that changes in ram block operation may be determined.

22. The method of claim 21, wherein the changes in ram block operation comprises changes in force displacement of the ram block, the method further comprising monitoring the force displacement of the ram blocks over time and determining potential wear of seals of the ram blocks.

23. The method of claim 20, wherein the wellsite data received from the wellsite comprises blowout preventer data generated by at least one seal sensor and at least one actuator sensor positioned about the blowout preventer.

24. The method of claim 20, further comprising determining maintenance schedules based on the blowout preventer parameters.

25. The method of claim 20, further comprising generating reports based on the wellsite data.

26. The method of claim 20, further comprising alerting the user when the blowout preventer parameters are out of range.

27. The method of claim 20, further comprising receiving input from the users.

28. The method of claim 20, further comprising analyzing the wellsite data.

29. The method of claim 20, further comprising generating blowout preventer outputs based on the analyzed data.

30. The method of claim 20, further comprising communicating the blowout preventer outputs to users at a plurality of locations in real time.

31. The method of claim 30, further comprising updating the blowout preventer outputs based on the integrated data.

32. The method of claim 31, further comprising adjusting blowout preventer operations at the wellsite in real time based on the updated blowout preventer outputs.

33. The method of claim 20, further comprising integrating wellsite data from the plurality of locations.

34. The method of claim 20, wherein the determining comprises aggregating and sorting the wellsite data.

* * * * *